US006562556B2

(12) United States Patent
Yokozawa

(10) Patent No.: US 6,562,556 B2
(45) Date of Patent: May 13, 2003

(54) SILVER HALIDE COLOR PHOTOGRAPHIC LIGHT-SENSITIVE MATERIAL

(75) Inventor: Akito Yokozawa, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/749,655

(22) Filed: Dec. 28, 2000

(65) Prior Publication Data

US 2002/0001783 A1 Jan. 3, 2002

(30) Foreign Application Priority Data

Dec. 28, 1999 (JP) ..... 11-374656

(51) Int. Cl.[7] ..... G03C 1/46

(52) U.S. Cl. ..... 430/505; 430/567; 430/543; 430/604; 430/605

(58) Field of Search ..... 430/505, 567, 430/543, 604, 605

(56) References Cited

U.S. PATENT DOCUMENTS 4,840,878 A 6/1989 Hirose et al. ..... 430/380
5,869,228 A 2/1999 Yokozawa ..... 430/540
6,043,020 A * 3/2000 Ohtani ..... 430/605
6,235,455 B1 * 5/2001 Ito et al. ..... 430/363
6,245,496 B1 * 6/2001 Yokozawa ..... 430/543

FOREIGN PATENT DOCUMENTS

JP 10-20460 A 1/1998

* cited by examiner

*Primary Examiner*—Geraldine Letscher
(74) *Attorney, Agent, or Firm*—Sughrue Mion, PLLC

(57) ABSTRACT

A silver halide color photographic light-sensitive material, which has at least one blue-sensitive silver halide emulsion layer containing a yellow coupler, at least one green-sensitive silver halide emulsion layer containing a magenta coupler, and at least one red-sensitive silver halide emulsion layer containing a cyan coupler, provided on a support, wherein at least one layer of said light-sensitive silver halide emulsion layers contains a silver halide emulsion comprising silver halide grains having a silver chloride content of 95 mol % or more, and wherein, with respect to each of characteristic curves obtained by a color development of said light-sensitive material after exposure, a specific relationship as defined by the density and the exposure amount is satisfied.

11 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material.

The present invention particularly relates to a silver halide color photographic light-sensitive material that excels in both rapid processing suitability and shading representation at the high density portion of an image obtained by a scanning exposure, and that is also suitable for a conventional "surface" exposure (a conventional flooding exposure).

The present invention also relates to a silver halide color photographic light-sensitive material that excels in rapid processing suitability; that restrains the change in color balance at the peripheral portion of a color photograph, and also provides high maximum colored density, upon a scanning exposure; and that is suitable for a surface exposure.

BACKGROUND OF THE INVENTION

Current widespread color photographs have become more rapidly and readily available by the improvement of light-sensitive materials and the progress of development processing technique. Particularly in the field of color printing, production of color photographs has been made in accordance with various ends, in lieu of such development as a centralization processing system, owing to production facilities having both a high-speed printer, for mass production, and a large-sized processing apparatus, or the like, which are called "color labs," and a dispersion processing system using a small-sized printer processor, which is called a "minilab" and is located in the front of a shop.

As to rapid processing, U.S. Pat. No. 4,840,878 discloses a technique of processing a color photographic light-sensitive material comprising a silver halide emulsion having a high silver chloride content, with a color-developing solution containing substantially neither sulfite ion nor benzyl alcohol. Actually, such a light-sensitive material comprising a silver halide emulsion having a high silver chloride content, and a processing method thereof according to the above-described technique, have been put to practical use. Consequently, color prints have become more rapidly and readily available.

Recently, in addition to printing by a conventional surface exposure, it has been practiced to provide a color print obtained from digital image data by reading a negative or positive image with a scanner. Digitalization of an image enables correction, such as gradation retouching, dodging (a shutting light method), and letter-printing at the time of producing a postcard, on the monitor of a computer, without preparing a lith film, and therefore digitalization contributes to improving both the productivity and quality of a color print. Further, digitalization of an image enables receiving image data via the Internet, and producing a color print using the same. The foregoing method is considered to become generalized in the future. In order to obtain a color print from digital image data, use can be made of various kinds of a scanning exposure apparatus of the type in which one pixel by one pixel is subjected to a scanning exposure to light from a light source, such as a cathode ray (CRT) and a laser, in place of a surface exposure through an ordinary negative film.

As mentioned above, as to technique to prepare a color print, printings by both conventional surface exposure and scanning exposure have been practiced, and color print materials for each exclusive use have been put to practical use. Therefore, at the site of color print preparation, two kinds of color print materials are necessary. However, if these different printing techniques could be handled with only a single kind of printing material, it would be convenient. As a result, it is desired to provide a color print material having both surface exposure and scanning exposure suitability.

As to a light-sensitive material having both surface exposure and scanning exposure suitability, U.S. Pat. No. 5,869,228 discloses a technique in which iron ions are locally contained in the surface region of high silver chloride emulsion grains, and further an o-hydroquinone-series compound or p-hydroquinone-series compound is incorporated in a light-sensitive material, whereby photographic properties obtained by a scanning exposure becomes equal to those obtained by a surface exposure. The present inventor studied the light-sensitive material manufactured by applying the foregoing technique. As a result, it was found that, with respect to a color print obtained by a scanning exposure, the problem arose that the shading at the high density portion became unnaturally great. It is possible to correct only the digital data of the shading portion, since the scanning exposure data are digitalized. However, the correction takes so much time and labor that ordinary color labs cannot accept it, in actual fact. Further, as to the light-sensitive material manufactured by applying the technique of the above-mentioned U.S. Pat. No. 5,869,228, it was found that, with respect to a color print obtained by a scanning exposure, another problem arose that the change in color balance became larger at the peripheral portion {for example, as to a one-sixth size (20.3 cm×25.4 cm), a region of from the end up to about 5 cm}. It is possible to restrain the change in color balance by correcting only digital data at the peripheral portion, since the scanning exposure data are digitalized. However, because the degree of change in color balance differs from one scanning exposure apparatus to another, correction is necessary for each apparatus, and this takes much time and labor. Therefore, the correction of digital data was difficult, in actual fact.

SUMMARY OF THE INVENTION

Accordingly, an object of the present invention is to provide a silver halide color photographic light-sensitive material that excels in both rapid processing suitability and shading representation at the high density portion of an image in a color print obtained by a scanning exposure, and that is also suitable for a conventional surface exposure.

Another object of the present invention is to provide a silver halide color photographic light-sensitive material that excels in rapid processing suitability; that restrains the change in color balance at the peripheral portion of a color photograph, and also provides high maximum colored density, upon a scanning exposure; and that is also suitable for a surface exposure.

Other and further objects, features, and advantages of the invention will appear more fully from the following description.

DETAILED DESCRIPTION OF THE INVENTION

As a result of an intensive study, the present inventor has found that the above-described objects of the present invention can be accomplished by the following means:

(1) A silver halide color photographic light-sensitive material, comprising at least one blue-sensitive silver halide emulsion layer containing a yellow coupler, at least one green-sensitive silver halide emulsion layer containing a magenta coupler, and at least one red-sensitive silver halide emulsion layer containing a cyan coupler, provided on a support, wherein at least one layer of said light-sensitive silver halide emulsion layers contains a silver halide emulsion comprising silver halide grains having a silver chloride content of 95 mol % or more, and wherein, with respect to each of characteristic curves obtained by a color development of said light-sensitive material after exposure, the following relationship is satisfied:

$$0.65 \leqq D1'/D1 \leqq 0.85$$

$$1.1 \leqq \log(E2/E1) \leqq 1.4$$

wherein D1 represents a density obtained by exposing to light in an exposure amount-ten times as much as that required to provide the density of [a density at the unexposed portion+0.02], in the characteristic curve obtained by a $10^{-1}$-sec exposure, D1' represents a density obtained by exposing to light in an exposure amount ten times as much as that required to provide the density of [a density at the unexposed portion+0.02], in the characteristic curve obtained by a $10^{-4}$-sec exposure, E1 represents an exposure amount required to provide the density of [a density at the unexposed portion+0.02], in the characteristic curve obtained by a $10^{-4}$-sec exposure, and E2 represents, in the characteristic curve obtained by a $10^{-4}$-sec exposure, an exposure amount required to provide the density 0.92 times the maximum density in the characteristic curve obtained by a $10^{-1}$-sec exposure.

(2) The silver halide color photographic light-sensitive material as described in the above item (1), wherein the relationship defined in the item (1), is satisfied in the characteristic curve obtained by a color development of said light-sensitive material after exposure to red light.

(3) The silver halide color photographic light-sensitive material as described in the above item (1) or (2), wherein said emulsion comprises silver halide grains having a silver chloride content of 95 mole % or more and doped with at least two kinds of complexes of metal of the group VIII in the periodic table. (Hereinafter, the silver halide color photographic light-sensitive materials described in the above (1) to (3) are referred to as the first embodiment of the present invention.)

(4) A silver halide color photographic light-sensitive material, comprising at least one blue-sensitive silver halide emulsion layer containing a yellow coupler, at least one green-sensitive silver halide emulsion layer containing a magenta coupler, and at least one red-sensitive silver halide emulsion layer containing a cyan coupler, provided on a support, wherein at least one layer of said light-sensitive silver halide emulsion layers contains a silver halide emulsion comprising silver halide grains having a silver chloride content of 95 mol % or more, and wherein, with respect to each of characteristic curves obtained by a color development of said light-sensitive material after exposure, the following relationship is satisfied:

$$0.65 \leqq D1'/D1 \leqq 0.85$$

$$0.90 \leqq D1''/D1' \leqq 1.00$$

$$0.90 \leqq D2'/D2 \leqq 1.00$$

$$0.90 \leqq D2''/D2' \leqq 1.00$$

wherein D1 represents a density obtained by exposing to light in an exposure amount ten times as much as that required to provide the density of [a density at the unexposed portion+0.02], in the characteristic curve obtained by a $10^{-1}$-sec exposure, D1' represents a density obtained by exposing to light in an exposure amount ten times as much as that required to provide the density of [a density at the unexposed portion+0.02], in the characteristic curve obtained by a $10^{-4}$-sec exposure, D1" represents a density obtained by exposing to light in an exposure amount ten times as much as that required to provide the density of [a density at the unexposed portion+0.02], in the characteristic curve obtained by a $10^{-6}$-sec exposure, D2 represents a density obtained by exposing to light in an exposure amount thirty times as much as that required to provide the density of [a density at the unexposed portion+0.02], in the characteristic curve obtained by a $10^{-1}$-sec exposure, D2' represents a density obtained by exposing to light in an exposure amount thirty times as much as that required to provide the density of [a density at the unexposed portion+0.02], in the characteristic curve obtained by a $10^{-4}$-sec exposure, and D2" represents a density obtained by exposing to light in an exposure amount thirty times as much as that required to provide the density of [a density at the unexposed portion+0.02], in the characteristic curve obtained by a $10^{-6}$-sec exposure.

(5) The silver halide color photographic light-sensitive material as described in the above item (4), wherein the relationship defined in the above item (4) is satisfied for a characteristic curve obtained by a color development of said light-sensitive material after exposure to a red light.

(6) The silver halide color photographic light-sensitive material as described in the above item (4) or (5), wherein at least one layer of said light-sensitive silver halide emulsion layers contains silver halide grains having a silver chloride content of 95 mol % or more, and doped with at least two kinds of complexes of metal of the group VIII in the periodic table, in the molar amounts of the complexes to be doped so as to become different from each other by twenty times or more.

(Hereinbelow, the silver halide color photographic light-sensitive materials described in the above (4) to (6) are referred to as the second embodiment of the present invention.)

Herein, the present invention means to include both the first embodiment and the second embodiment, unless otherwise specified.

The present invention will be explained in more detail below.

The silver halide color photographic light-sensitive material of the present invention is defined by the characteristics relating to each of characteristic curves obtained by the following method:

A light-sensitive material is subjected to a gradation exposure for sensitometry using a blue, green or red light, followed by color-development processing. Colored densities thus obtained are measured, to obtain each characteristic curve corresponding to the blue, green or red light. Further, by changing the above-mentioned exposure time to $10^{-1}$ sec, $10^{-4}$ sec, and $10^{-6}$ sec, characteristic curves corresponding to the $10^{-1}$ sec, $10^{4}$ sec, and $10^{-6}$ sec can be obtained. The light-sensitive material of the present invention needs to satisfy the following relationship (1) and/or (2), for any one of the thus-obtained characteristic curves corresponding to a blue, green or red light. It is preferred to satisfy the following relationship (1) and/or (2) for the characteristic curve corresponding to a red light.

Relationship (1)

$$0.65 \leqq D1'/D1 \leqq 0.85$$

$$1.1 \leqq \log(E2/E1) \leqq 1.4$$

D1 represents a density obtained by exposing to light in an exposure amount ten times as much as that required to provide the density of [a density at the unexposed portion+0.02], in the characteristic curve obtained by exposure for a $10^{-1}$-sec exposure time, D1' represents a density obtained by exposing to light in an exposure amount ten times as much as that required to provide the density of [a density at the unexposed portion+0.02], in the characteristic curve obtained by exposure for a $10^{-4}$-sec exposure time, E1 represents an exposure amount required to provide the density of [a density at the unexposed portion+0.02], in the characteristic curve obtained by exposure for a $10^{-4}$-sec exposure time, and E2 represents, in the characteristic curve obtained by exposure for a $10^{-4}$-sec exposure time, an exposure amount required to provide the density 0.92 times the maximum density in the characteristic curve obtained by exposure for a $10^{-1}$-sec exposure time.

In the case where the log(E2/E1) is less than 1.1, the shading at the high density portion of the image obtained by a scanning exposure becomes unnaturally strong. Further, in the case where the log(E2/E1) is greater than 1.4, the shading at the high density portion of the image obtained by a scanning exposure becomes weak, resulting in an indefinite image (having insufficient depth). On the other hand, in the case where the log(E2/E1) is within the range of 1.1 to 1.4 as defined in the first embodiment of the present invention, depth (conciseness) of the shading at the high density portion of the image obtained by a scanning exposure is excellent. More preferably the log(E2/E1) is in the range of 1.15 to 1.35. In the case where the D1'/D1 is greater than 0.85 or it is less than 0.65, even though the log(E2/E1) is within the range defined in the first embodiment of the present invention, a relation of the shading is of low grade resulting in difficulty in representing a pale shading. Therefore, it is necessary to adjust the D1'/D1 to the range defined in the first embodiment of the present invention. More preferably the D1'/D1 ranges from 0.68 to 0.82.

Relationship (2)

$$0.65 \leqq D1'/D1 \leqq 0.85$$

$$0.90 \leqq D1''/D1' \leqq 1.00$$

$$0.90 \leqq D2'/D2 \leqq 1.00$$

$$0.90 \leqq D2''/D2' \leqq 1.00$$

D1 represents a density obtained by exposing to light in an exposure amount ten times as much as that required to provide the density of [a density at the unexposed portion+0.02], in the characteristic curve obtained by exposure for a $10^{-1}$-sec exposure time, D1' represents a density obtained by exposing to light in an exposure amount ten times as much as that required to provide the density of [a density at the unexposed portion+0.02], in the characteristic curve obtained by exposure for a $10^{-4}$-sec exposure time, D1" represents a density obtained by exposing to light in an exposure amount ten times as much as that required to provide the density of [a density at the unexposed portion+0.02], in the characteristic curve obtained by exposure for a $10^{-6}$-sec exposure time, D2 represents a density obtained by exposing to light in an exposure amount thirty times as much as that required to provide the density of [a density at the unexposed portion+0.02], in the characteristic curve obtained by exposure for a $10^{-1}$-sec exposure time, D2' represents a density obtained by exposing to light in an exposure amount thirty times as much as that required to provide the density of [a density at the unexposed portion+0.02], in the characteristic curve obtained by exposure for a $10^{-4}$-sec exposure time, and D2" represents a density obtained by exposing to light in an exposure amount thirty times as much as that required to provide the density of [a density at the unexposed portion+0.02], in the characteristic curve obtained by exposure for a $10^{-6}$-sec exposure time.

The exposure herein used to obtain the characteristic curve defined by the present invention refers to the above-mentioned "surface" exposure.

If D2'/D2 is less than 0.90, the maximum colored density obtained by a scanning exposure decreases. In the case that D2"/D2' is less than 0.90, the maximum colored density to be obtained sometimes decrease when some types of scanning exposure apparatus are used. Such a light-sensitive material is not suitable for a wide use. Only in the case that both D2'/D2 and D2"/D2' each are 0.90 or more, a satisfactory amount of the maximum colored density can be obtained, regardless the type of scanning exposure apparatus. However, in the case that D1'/D1 is less than 0.65 or it is more than 0.85, even though both D2'/D2 and D2"/D2' are in the ranges defined in the second embodiment of the present invention, such a problem arose that the change in color balance at the peripheral portion of the image obtained by a scanning exposure sometimes became larger. As to the image of a nearly primary color, the change in color balance was hardly observed. However, as to the image of a neutral color balance, i.e., gray, the change in color balance was remarkable. To control D1'/D1in the range of 0.65 to 0.85 enables to restrain the change in color balance at the peripheral portion within an allowable range. In the case that D1"/D1' is less than 0.90, some types of scanning exposure apparatus sometimes cannot restrain the change in color balance at the peripheral portion within an allowable range. Such a light-sensitive material is not suitable for a wide use. To control D1"/D1' in the range of 0.90 to 1.00 allows to restrain, within an allowable range, the change in color balance at the peripheral portion of the image obtained by every type of scanning exposure apparatus. D2'/D2 is more preferably in the range of 0.93 to 1.00. D2"/D2' is more preferably in the range of 0.93 to 1.00. D1'/D1 is more preferably in the range of 0.68 to 0.82. D1'/D1' is more preferably in the range of 0.93 to 1.00.

In this specification, the exposure defined by only a second (sec.) of exposure time always refers to a surface exposure, unless otherwise specifically mentioned.

As a light source for use in the present invention, there is no particular limitation, so long as they are able to provide a luminous intensity required for each of several exposures. For example, ordinary halogen lamp and mercury lamp may be used. The exposure for obtaining a characteristic curve resulting from an exposure to a light having a specific wavelength, as defined in the present invention, can be carried out using a light of the specific wavelength, which is taken out through a color filter according to an ordinary method. Therefore, the light source per se may contain a light of a wavelength which is sensitive to light-sensitive layers other than a light-sensitive layer which is sensitive to light of the specific wavelength region.

In order to obtain a characteristic curve defined in the present invention, it is preferred to contain two or more kinds of silver halide emulsion having a different photographic speed from each other, in the same silver halide emulsion layer as described above. Using a characteristic curve which is obtained by exposing and color developing a light-sensitive material which comprises a silver halide emulsion layer containing only one kind of the emulsion, an exposure amount (E) required to provide a colored density of 60% of the maximum density obtained by, for example, a $10^{-1}$-sec exposure, and an exposure amount (E') required to provide a colored density of 10% of the maximum density obtained by, for example, a $10^{-1}$-sec exposure are measured. Log(1/E) is defined as a middle density sensitivity, and log(1/E') as a low density sensitivity. In this case, among two or more kinds of the emulsion contained in the same silver halide emulsion layer, a difference in sensitivity between the highest sensitive emulsion and the lowest sensitive emulsion is preferably in the range of 0.05 to 0.60, more preferably in the range of 0.10 to 0.50, in terms of both the low density sensitivity and the middle density sensitivity resulting from a $10^{-1}$-sec exposure. Further, it is preferable that a difference in the middle density sensitivity resulting from a $10^{-4}$-sec exposure is larger by at least 0.05 than a difference in the middle density sensitivity obtained by a $10^{-1}$-sec exposure. Further, it is more preferable that a difference in the low density sensitivity resulting from a $10^{-4}$-sec exposure is almost the same (within 0.05) as a difference in the low density sensitivity obtained by a $10^{-1}$-sec exposure.

Further, as to the relationship of the sensitivities obtained by $10^{-4}$-sec exposure and $10^{-6}$-sec exposure, the difference of sensitivities at a $10^{-4}$-sec exposure and the difference of sensitivities at a $10^{-6}$-sec exposure, preferably have a difference within 0.05, respectively, in both the difference of middle density sensitivities and the difference of low density sensitivities.

In order to change a photographic speed of the silver halide emulsion, usually the size of silver halide emulsion grains is changed. Generally, a photographic speed can be enhanced by making the grain size larger, or it can be lowered by making the grain size smaller. It is more preferable that each of these silver halide emulsion grains having a different size be mono-dispersed grains.

In order to obtain a silver halide emulsion whose photographic property owing to each exposure time has the characteristics defined by the present invention, it is also preferred to use, in the preparation of the emulsion, the techniques, such as regulation of the amount of a chemical sensitizer, regulation of the chemical sensitization conditions (pAg, pH, temperature, time, etc.), and/or addition of a complex of metal of the group VIII of the periodic table to be contained in the silver halide emulsion and regulation of the amount of the complex, etc., in addition to (in combination with) alteration of the size of silver halide emulsion grains as mentioned above. Among these techniques, more preferred is to use the technique in which a complex of metal of the group VIII of the periodic table is incorporated in a silver halide emulsion in combination with the alteration of the grain size.

For example, in the case where a silver halide emulsion layer contains two kinds of silver halide emulsions each containing both a complex of metal of the group VIII of the periodic table and chemically sensitized silver halide grains having a different grain size from each other, the value of log(E2/E1) can be changed, without a substantial change in the value of D1'/D1, by changing the amount of the complex of metal of the group VIII of the periodic table, which is incorporated in the emulsion having a smaller grain size. On the other hand, by changing the amount of the complex of metal of the group VIII of the periodic table, which is incorporated in the emulsion having a larger grain size, the value of D1'/D1 can be changed without a substantial change in the value of log(E2/E1). Namely, the values of D1'/D1and log(E2/E1) can almost independently be changed by individually altering the amount of the complex of metal of the group VIII of the periodic table, which is incorporated in the silver halide emulsion having a smaller grain size or a larger grain size, respectively.

Further, for example, in the case where a silver halide emulsion layer contains two kinds of silver halide emulsions each containing both a complex of metal of the group VIII of the periodic table and chemically sensitized silver halide grains having a different grain size from each other, the values of both D2'/D2 and D2"/D2' can be changed corresponding to a variation of the values of both D1'/D1 and D1"/D1' by changing the amount of the complex of metal of the group VIII of the periodic table, which is incorporated in the emulsion having a smaller grain size. On the other hand, by changing the amount of the complex of metal of the group VIII of the periodic table, which is incorporated in the emulsion having a larger grain size, the values of both D1'/D1 and D1"/D1' can be changed without a substantial change in the values of both D2'/D2 and D2"/D2'. Namely, the values of D1'/D1, D1"/D1', D2'/D2 and D2"/D2' can almost independently be changed by individually altering the amount of the complex of metal of the group VIII of the periodic table, which is incorporated in the silver halide emulsion having a smaller grain size or a larger grain size, respectively.

In the silver halide color light-sensitive material of the present invention, it is preferred to dope silver halide grains with a complex of metal of the group VIII of the periodic table. The metal complex may be incorporated in the silver halide grains at the time of the formation of the silver halide grains, by allowing them to be present in an aqueous solution of gelatin or another protective colloidal polymer as a dispersion medium, an aqueous solution of halide, an aqueous solution of silver salt, or other aqueous solutions. Further, in the case where a silver bromide-localized phase is formed by addition of silver bromide fine grains and/or silver chlorobromide fine grains, the metal complex can also be incorporated selectively in the silver bromide-localized phase by using fine grains which have previously contained the metal complex.

In the present invention, it is preferred to add a complex of metal of the group VIII of the periodic table to the silver halide grain in a light-sensitive silver halide emulsion layer, more preferably in a red-sensitive emulsion layer. Examples of the metal complex include complexes of iron, cobalt, nickel, ruthenium, rhodium, iridium or platinum. Among these, complexes of iron, iridium or ruthenium are preferably used. It is more preferable that a complex of iron or ruthenium be concentrated on the surface layer which is 50% or less of the volume of a silver halide grain so as to become richer than the other portion of the silver halide grain. The term "50% or less of the volume of a grain"

herein used refers to a surface portion equivalent to 50% or less of the volume of one grain. The surface portion is more preferably 40% or less by volume, furthermore preferably 20% or less by volume. Iridium complex is also preferably contained in the silver bromide rich phase as mentioned above, in addition to the embodiment that it is added at the time of the formation of silver halide grain to contain therein.

Further, it is most preferable that a Group VIII metal complex for use in the present invention be used in combination of two or more kinds thereof rather than a single use. In the case where two or more kinds of Group VIII metal complexes are contained in the same emulsion grain, any two kinds of these metal complexes are preferably contained in a different molar amount from each other. More preferably one complex be contained in the molar amount 20 times or more, most preferably 30 times or more and 10,000 times or less, as much as that of the other, respectively. In the present invention, it is preferred to use complexes of iron and iridium, or complexes of ruthenium and iridium in combination, respectively.

Specific examples of iron, ruthenium and iridium complexes which can be used to incorporate in silver halide grains are shown below. However, the present invention should not be limited to these compounds.

(Iron compounds)

Ferrous arsenate, ferrous bromide, ferrous carbonate•monohydrate, ferrous chloride, ferrous citrate, ferrous fluoride, ferrous formate, ferrous gluconate, ferrous hydroxide, ferrous iodide, ferrous lactate, ferrous oxalate•dihydrate, ferrous succinate, ferrous sulfate•heptahydrate, ferrous thiocyanate•trihydrate, ferrous nitrate•hexahydrate, ammonium iron (II) nitrate, basic ferric acetate, ferric albuminate, ammonium iron (III) acetate, ferric bromide, ferric chloride, ferric chromate, ferric citrate, ferric fluoride, ferric formate, ferric glycerophosphate, ferric hydroxide, acidic ferric phosphate, ferric nitrate•nonahydrate, ferric phosphate, ferric pyrophosphate, sodium iron (III) pyrophosphate, ferric thiocyanate, ferric sulfate•nonahydrate, ammonium iron (III) sulfate, guanidinium iron (III) sulfate, ammonium iron (III) citrate, potassium hexacyano ferrate (II)•trihydrate, potassium pentacyanoammine ferrate (II), sodium ethylenedinitrilotetraacetato ferrate (III), potassium hexacyano ferrate (III).

(Ruthenium Compounds)

Ruthenium (VI) fluoride, ruthenium (IV) chloride•heptahydrate, potassium hexachlororuthenate (IV), ruthenium (III) chloride, ruthenium (III) bromide, ruthenium (III) iodide, hexaammine ruthenium (III) bromide, chloropentaammine ruthenium (III) chloride, hexaammine ruthenium (II) chloride, potassium hexacyano ruthenate (II) •trihydrate.

(Iridium Compounds)

Potassium hexachloro iridate (IV), potassium hexabromo iridate (IV), ammonium hexachloro iridate (IV), iridium (III) bromide•tetrahydrate, iridium (III) iodide, potassium hexachloro iridate (III)•trihydrate, potassium hexabromo iridate (III), potassium tris(oxarato) iridate (III) •tetrahydrate, potassium hexacyano iridate (III), iridium (II) chloride.

Of these compounds, particularly preferred are hexacyano ferrate (II) salts, hexacyano ferrate (III) salts, hexacyano ruthenate (II) salts, hexachloro iridate (IV) salts, hexabromo iridate (IV) salts, hexachloro iridate (III) salts, and hexabromo iridate (III) salts.

The amount to be added of these metal ions belonging to the group VIII, though it may change over a wide range in accordance with their intended usage, is preferably $10^{-9}$ mol to $10^{-3}$ mol, and more preferably $10^{-8}$ mol to $5\times10^{-4}$ mol, per mol of silver halide.

In addition to the metal ions belonging to the group VIII of the periodic table, other metals, such as copper, gold, zinc, cadmium, and lead, may be contained. These metals may be contained together with the metal(s) of the group VIII in the same layer, or they may be contained in a layer free of the metal of group VIII, in accordance with their intended usage. The amount to be added of these metal ions, though it may change over a wide range in accordance with their intended usage, is generally preferably from $10^{-9}$ mol to $10^{-2}$ mol per mol of silver halide.

The silver halide emulsion for use in the present invention is generally subjected to chemical sensitization. As to the chemical sensitization method, sulfur sensitization typified by the addition of an unstable sulfur compound, noble metal sensitization typified by gold sensitization, and reduction sensitization may be used independently or in combination. As compounds used for the chemical sensitization, those described in JP-A-62-215272 ("JP-A" means unexamined published Japanese patent application), page 18, right lower column to page 22, right upper column are preferably used.

Preferably the silver halide emulsion for use in the present invention is subjected to gold sensitization in a usual manner. In order to carry out gold sensitization, compounds, such as chloroauric acid or a salt thereof, gold thiocyanates and gold thiosulfates, may be used. The amount of these compounds to be added may spread over a wide range corresponding to the occasion. However, the amount is preferably in the range of $5\times10^{-7}$ mole to $5\times10^{-3}$ mole, more preferably in the range of $1\times10^{-6}$ mole to $1\times10^{-4}$ mole, per mole of silver halide.

In the present invention, gold sensitization may be used in combination with other sensitizing method, for example, sulfur sensitization, selenium sensitization, tellurium sensitization, reduction sensitization, or noble metal sensitization using a noble metal other than a gold compound.

In the silver halide color photographic material of the present invention, silver halide grains having a silver chloride content of 95 mole % or more are contained in at least one light-sensitive silver halide emulsion layer. Preferably the silver halide grains having a silver chloride content of 95 mole % or more are contained in a red-sensitive emulsion layer. More preferably the silver halide grains having a silver chloride content of 95 mole % or more are contained in a blue-sensitive emulsion layer, a green-sensitive emulsion layer and a red-sensitive emulsion layer.

The silver chloride content is preferably 96 mole % or more, and further preferably 97 mole % or more and less than 100 mole %.

In the light-sensitive material of the present invention, a silver bromide-rich phase is preferably provided to the silver halide grains having a silver chloride content of 95 mole % or more. Preferably the silver bromide-rich phase is prepared by epitaxially growing a localized phase having a silver bromide content of 10 mole % or more in terms of the content (percentage) of total silver bromide in the silver bromide-rich phase. The silver bromide content of the silver bromide-rich phase is preferably 10 mole % or more in total. However, if the silver bromide content is excessively high, the silver bromide-rich phase sometimes imparts unpreferable characteristics against the photographic light-sensitive material, such that when a pressure is applied to a light-sensitive material, desensitization occurs, and that sensitivity and/or gradation are substantially altered by fluctuation in the composition of a processing solution. Taking these points into consideration, the silver bromide content of the silver bromide-rich phase is preferably in the range of 10 mole % to 60 mole %, most preferably in the range of 20 mole % to 50 mole %. The silver bromide content of the silver bromide-rich phase can be analyzed according to X-ray diffraction method (for example, *Shin-Jikken Kagaku Koza* 6, *Kozo Kaiseki* (*New Experimental Chemistry Course* 6, *Analysis of Structure*), edited by Nihon kagaku kai, published by Maruzen), or the like. The silver bromide-rich phase is preferably composed of 0.1 mole % to 5 mole %, more preferably 0.3 mole % to 4 mole % of the total silver amount of the silver halide grains for use in the present invention.

The steps of preparing the silver halide emulsion for use in the present invention is composed of a silver halide grain-forming step utilizing a reaction between a water-soluble silver salt and a water-soluble halide, a desalting step, and a chemical ripening step, as generally well-known in the art. In present invention, the silver bromide-rich phase may be provided in any course of the foregoing steps. However, the silver bromide-rich phase is preferably provided after the desalting step, especially preferably after completion of the desalting step but before completion of chemical sensitization. It is preferred to incorporate complex ions of metal of the group VIII such as $IrCl_6^{2-}$ in the silver bromide-rich phase. Further, when an iridium compound is incorporated in the silver bromide-rich phase of the silver halide emulsion grains, it is preferable that said rich phase is deposited together with at least 50 mole % of the total iridium to be added at the time of preparation of silver halide grains. It is more preferable that said rich phase is deposited together with at least 80 mole % of the total iridium to be added. It is most preferable that said rich phase is deposited together with the total iridium to be added. The phrase "said rich phase is deposited together with iridium" as used herein means that an iridium compound is supplied at the same time as a silver or halogen supply, just before a silver or halogen supply, or immediately after a silver or halogen supply, for formation of said rich phase. In the case where a silver bromide-rich phase is formed by mixing silver halide host grains and silver halide fine grains having a shorter average grain size and higher silver bromide content than those of said host grains, and thereafter ripening the resulting mixture, it is preferable that an iridium salt is previously incorporated in the silver halide fine grains having a high silver bromide content.

The silver halide grains for use in the present invention may be those having (100) planes, those having (111) planes, or those having both (100) planes and (111) planes, on an outer surface area, or they may contain higher dimensional planes. However, cube and tetradecahedron, each of which is mainly composed of (100) planes, are preferred. The size of the silver halide grains for use in the present invention may be in the range of the grain size usually employed in the art. However, the average grain size is preferably in the range of 0.1 $\mu$m to 1.5 $\mu$m. The grain size distribution may be a polydispersion or monodispersion. The latter is preferred. The variation coefficient of the grain size that indicates the degree of the monodispersion is preferably 0.2 or less, more preferably 0.15 or less, in terms of the ratio (s/d) of a statistical standard deviation (s) to an average grain size (d). Further, in order to provide a desired gradation, a blend of two or more of the foregoing monodisperse emulsions different in sensitivity preferably can be used in the same silver halide emulsion layer.

With respect to the shape of silver halide grains for use in the present invention, those having a regular crystal form, such as cubic or tetradecahedral as well as octahedral, an irregular crystal form, such as spherical, tabular, or the like, or a composite form of these forms, can be used. Further, grains having a mixture of these various crystal forms may also be used. It is preferred in the present invention that the proportion of the grains having such a regular crystal form as described above to the entire grains be 50% or more, preferably 70% or more, and more preferably 90% or more, in terms of wt %. Further, in addition to the grains having a regular crystal form, an emulsion in which the proportion of tabular grains having an average aspect ratio {the ratio of an equivalent circular diameter (which means a diameter of a circle equivalent to a grain's projected area)/a grain thickness} of generally 5 or more, preferably 8 or more, to the entire grains is 50% by weight or more as a projected area can also be preferably used. The silver halide emulsion that is used in the present invention can be prepared according to the methods disclosed, for example, by P. Glafkides, in *Chimie et Physique Photographique,* Paul Montel (1967), by G. F. Duffin, in *Photographic Emulsion Chemistry,* Focal Press (1966), by V. L. Zelicman, et al., in *Making and Coating Photographic Emulsion,* Focal Press (1964), and the like. That is, any process, such as an acid process, a neutral process, and an ammoniacal process, can be used. Any of a single jet method, a double jet method, and a combination of them may be used as methods for reacting a soluble silver salt with a soluble halide. A method in which silver halide grains are formed in the atmosphere of excessive silver ion (a so-called reverse mixing method) can also be used. Further, a so-called controlled double jet method, which is one form of a double jet method, in which the pAg of the liquid phase in which the silver halide is formed is maintained constant, can also be used. According to this method, a silver halide emulsion having a regular crystal form and substantially a uniform grain size can be obtained.

Various compounds can be included in the silver halide emulsion for use in the present invention, to prevent fogging from occurring or stabilize photographic performances during manufacture, storage or photographic processing of the photographic material. That is, as a compound which can be added to the silver halide emulsion, there are many compounds known as an antifogging agent or stabilizer, such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole and the like); mercaptopyrimidines, mercaptotriazines; thioketo compounds such as oxazolinethione; azaindenes, for example, triazaindenes, tetrazaindenes (particularly 4-hydroxy-substituted (1,3,3a,7)tetrazaindene), and pentazaindenes; benzenethiosulfonic acid, benzenesulfinic acid, and benzenesulfonamide. Mercaptotetrazoles are especially preferred. These compounds preferably act so that a high illumination intensity speed can be further enhanced, in addition to antifogging and stabilization.

As a hydrophilic binder which may be used in the silver halide color photographic light-sensitive material of the present invention, gelatin is generally used. However, as occasion demands, gelatin may be used in combination with any other hydrophilic colloid, such as other gelatin derivatives, graft copolymers of gelatin and other high molecules, proteins other than gelatin, sugar derivatives, cellulose derivatives, and synthetic hydrophilic high molecular materials such as homo- or copolymers.

The gelatin which is used in the silver halide color photographic light-sensitive material of the present invention may be a lime-processed gelatin, or an acid-processed gelatin. Further, it may be a gelatin manufactured by employing any one of a cattle bone, a cattle skin and a pig skin as a raw material. A lime-processed gelatin manufactured by employing the cattle bone or the pig skin as a raw material is preferred.

In the present invention, the total amount of a hydrophilic binder to be contained in light-sensitive silver halide emulsion layers and light-insensitive hydrophilic colloid layers extending from a support to the hydrophilic colloid layers furthest from the silver halide emulsion-coating side of the support, is preferably 8.0 g/m$^2$ or less, most preferably from 7.0 g/m$^2$ to 4.0 g/m$^2$, from the viewpoint of a rapid processing. A small amount of a hydrophilic binder has an effect especially on advances in both color developing and washing speed.

In the present invention, the silver halide emulsion layer containing a yellow coupler may be arranged in any position on the support. For example, when silver halide tabular grains are used in the silver halide emulsion coating a yellow coupler, the layer containing a yellow coupler is coated preferably in a position more apart from the support than at least one layer of the magenta coupler-containing silver halide emulsion layer and the cyan coupler-containing silver halide emulsion layer. Further, from the viewpoint of acceleration of color development, acceleration of silver removal, and reduction of a residual color by a sensitizing dye, the yellow coupler-containing silver halide emulsion layer is coated preferably in the most apart position from the support than the other silver halide emulsion layers. Further, from the viewpoint of a reduction in Blix discoloration, the cyan coupler-containing silver halide emulsion layer is preferably a middle layer between the other silver halide emulsion layers, and from the viewpoint of a reduction in light discoloration, the cyan coupler-containing silver halide emulsion layer is preferably the lowermost layer. Further, each color-forming layer of yellow, magenta or cyan may be composed of 2 or 3 layers. For example, it is preferable that a coupler layer not containing a silver halide emulsion is arranged to be adjacent to the silver halide emulsion layer, to form a color-forming layer, as described in JP-A-4-75055, JP-A-9-114035, JP-A-10$^{-246940,}$ U.S. Pat. No. 5,576,159, etc.

In the yellow coupler-containing silver halide emulsion layer, the amount of the hydrophilic binder is preferably 1.55 g/m$^2$ or less, more preferably 1.45 g/m$^2$ or less, most preferably 1.35 g/m$^2$ or less but 0.60 g/m$^2$ or more. Further, with respect to the thickness of the silver halide emulsion, the side length in the case where cubic grains are used is preferably 0.80 $\mu$m or less, more preferably 0.75 $\mu$m or less, most preferably 0.70 $\mu$m or less but 0.30 $\mu$m or more, and the side length in the case where tabular grains are used is preferably 0.40 $\mu$m or less but 0.02 $\mu$m or more, more preferably 0.30 $\mu$m or less, further preferably 0.20 $\mu$m or less, most preferably 0.15 $\mu$m or less but 0.05 $\mu$m or more. An aspect ratio of tabular grains is preferably 2 to 10, more preferably 3 to 8. A mixture of silver halide emulsions having different sizes and/or shapes is preferably used to control sensitivity, gradation and other photographic performance.

In the present invention, the amount of the silver halide emulsion to be coated is preferably 0.70 to 0.10 g/m$^2$, more preferably 0.65 to 0.20 g/m$^2$, most preferably 0.55 to 0.25 g/m$^2$.

When cubic silver halide emulsion grains are used in the cyan-color-forming layer and the magenta-color-forming layer, the side length thereof is preferably 0.70 $\mu$m or less, more preferably 0.50 $\mu$m or less but 0.10 $\mu$m or more.

In the present invention, the film thickness in the constitution of the photographic layer means the thickness, before processing, in the constitution of the photographic layer which is a layer over the support. Specifically, the film thickness can be obtained in any one of the following methods. In the first method, the film thickness can be obtained by cutting the silver halide color photographic light-sensitive material in a direction perpendicular to the support, and observing its cut surface under a microscope. The second method is a method of calculating the film thickness from the coating amount (g/m$^2$) and specific gravity of each component in the constitution of the photographic layer.

For example, the specific gravity of typical gelatin for use in photography is 1.34 g/ml, and the specific gravity of silver halide is 5.59 g/ml, and other lipophilic additives are previously measured before coating, whereby the film thickness can be calculated in the second method.

In the present invention, the film thickness in the photographic layer constitution is preferably 10.0 $\mu$m or less, more preferably 9.5 $\mu$m or less, most preferably 9.0 $\mu$m or less but 3.5 $\mu$m or more.

In the present invention, the hydrophobic photographic material is an oil-soluble ingredient excluding the dye-forming coupler, and the oil-soluble ingredient is a lipophilic component remaining in the light-sensitive material after processing. Specific examples of the oil-soluble ingredient include the dye-forming coupler, a high-boiling organic solvent, a color-mixing inhibitor, an ultraviolet absorber, lipophilic additives, a lipophilic polymer or polymer latex, a matt agent, a slip (sliding) agent or the like, which are usually added as lipophilic fine-grains to the photographic constitutional layer. Accordingly, a water-soluble dye, a hardening agent, water-soluble additives and silver halide emulsions are not included in the oil-soluble ingredient. Further, a surfactant is usually employed in preparing lipophilic fine grains, and the surfactant is not regarded as the oil-soluble ingredient in the present invention.

The total amount of the oil-soluble ingredient in the present invention is preferably 5.5 g/m$^2$ or less, further preferably 5.0 g/m$^2$ or less, most preferably 4.5 g/m$^2$ or less but 3.0 g/m$^2$ or more. In the present invention, the value obtained by dividing the weight (g/m$^2$) of the hydrophobic photographic material contained in the dye-forming coupler-containing layer by the weight (g/m$^2$) of said dye-forming coupler, is preferably 4.5 or less, more preferably 3.5 or less, and most preferably 3.0 or less.

In the present invention, the ratio of the oil-soluble ingredient in the photographic layer constitution to the hydrophilic binder can be arbitrarily selected. The ratio thereof by weight in the photographic layer constitution other than the protective layer is preferably 0.05 to 1.50, more preferably 0.10 to 1.40. By optimizing the ratio of each layer, the film strength, abrasion resistance and curl characteristics can be regulated.

In the light-sensitive material according to the present invention, for the purpose of improving the sharpness or the like of images, dyes (particularly oxonol-type dyes), which can be decolored by processing, as described on pages 27 to 76 in European Patent Application No. 337,490A2, are preferably added to the hydrophilic colloidal layer such that the optical reflection density of the light-sensitive material at 680 nm becomes 0.50 or more, or 12 wt % or more (more preferably 14 wt % or more) of titanium oxide which is surface-treated with di- to tetra-hydric alcohols (e.g. trimethylol ethane) is preferably contained in a water-resistant resin layer of a support.

In the silver halide photographic light-sensitive material of the present invention, other conventionally known photographic materials and additives can be used.

For example, a transparent-type base or a reflective-type base can be used as the photographic base (support). As the transparent-type base, a transparent film, such as a cellulose nitrate film and a polyethylene terephthalate film; and one wherein a film, for example, of a polyester of 2,6-naphthalenedicarboxylic acid (NDCA) and ethylene glycol (EG) or a polyester of NDCA, terephthalic acid, and EG, is provided with an information recording layer, such as a magnetic layer, are preferably used. As a reflective-type base, particularly, a reflective-type base, wherein a laminate has a plurality of polyethylene layers or polyester layers and wherein at least one of such water-resistant resin layers (laminated layers) contains a white pigment, such as titanium oxide, is preferable.

Further, the above water-resistant resin layers preferably contain a fluorescent whitening agent. Further, a fluorescent whitening agent may be dispersed in the hydrophilic colloid layer of the light-sensitive material. As the fluorescent whitening agent, preferably a benzoxazole-series fluorescent whitening agent, a cumarin-series fluorescent whitening agent, or a pyrazoline-series fluorescent whitening agent can be used, and more preferably a benzoxazolylnaphthalene-series fluorescent whitening agent or a benzoxazolylstilbene-series fluorescent whitening agent is used. The amount to be used is not particularly limited, but preferably it is 1 to 100 mg/m$^2$. When it is mixed with a water-resistant resin, preferably the mixing proportion is 0.0005 to 3% by weight, and more preferably 0.001 to 0.5% by weight, to the resin.

The reflective-type base may be one wherein a hydrophilic colloid layer containing a white pigment is applied on a transparent-type base or a reflective-type base described in the above.

Further, the reflective-type base may be a base having a specular reflective- or a second-type diffusion reflective metal surface.

For the above reflective-type base, silver halide emulsions, as well as different metal ion species to be doped into silver halide grains, antifoggants or storage stabilizers of silver halide emulsions, chemical sensitizing methods (sensitizers) and spectrally sensitizing methods (spectral sensitizers) for silver halide emulsions, cyan, magenta, and yellow couplers and methods for emulsifying and dispersing them, dye-image-preservability improving agents (antistaining agents and anti-fading agents), dyes (colored layers), gelatins, layer structures of light-sensitive materials, the pH of coatings of light-sensitive materials, and the like, those described in the patents shown in Tables 1 and 2 can be preferably applied in the present invention.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |

TABLE 1-continued

| Element | JP-A-7-104448 | JP-A-7-77775 | JP-A-7-301895 |
|---|---|---|---|
| Storage stabilizers or antifoggants | Column 75, lines 9 to 18 | Column 47, lines 20 to 29 | Column 18, line 11 to Column 31, line 37 (Especially, mercapto-heterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods lines 35 to 48 | Column 71, line 3 to Column 72, line 11 | Column 61, lines 36 to 49 | Column 87, lines 35 to 48 |

TABLE 2

| Element | JP-A-7-104448 | JP-A-7-77775 | JP-A-7-301895 |
|---|---|---|---|
| Dye-image-preservability improving agents (antistaining agents) Anti-fading agents | Column 39, line 50 to Column 70, line 9 Column 70, line 10 to Column 71, line 2 | Column 61, line 50 to Column 62, line 49 | Column 87, line 49 to to Column 88, line 48 |
| Dyes (coloring agents) | Column 77, line 42 Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, lines 38 to Column 32, line 33 |
| pH of coatings of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As the cyan, magenta, and yellow couplers additionally used in the present invention, further, couplers described, for example, in JP-A-62-215272, page 91, right upper column, line 4 to page 121, left upper column, line 6; JP-A-2-33144, page 3, right upper column, line 14 to page 18, left upper column, the last line, and page 30, right upper column, line 6 to page 35, right lower column, line 11; and EP-A-0 355 660 (A2), page 4, line 15 to line 27, page 5, line 30 to page 28, the last line, page 45, line 29 to line 31, and page 47, line 23 to page 63, line 50, JP-A-8-122984, and JP-A-9-222704 are also useful. Further, as the cyan coupler, pyrazolotriazole couplers are preferably used. Among these couplers especially preferred are those represented by formula (I) or (II) in JP-A-5-313324 and those represented by formula (I) in JP-A-6-347960 and exemplified couplers described in these patent publications.

In the present invention, known color-mixing preventing agents may be used. Among the agents, those described in the following patent publications are preferable.

For example, high molecular weight redox compounds described in JP-A-5-333501, phenidone- or hydrazine-series compounds described in Japanese patent application No. 9-140719 and U.S. Pat. No. 4,923,787, and white couplers described in JP-A-5-249637, JP-A-10$^{-282615}$ and German Patent No.19629142A1 may be used. In order to raise the pH of a developing solution and to promote developing rate in particular, it is preferable to use redox compounds described, for example, in German Patent Nos.19618786A1 and 19806846A1, EP Patent Nos.839623A1 and 842975A1, and France Patent No.2760460A1.

In the present invention, an ultraviolet light absorber having high molar extinction coefficient is preferably used as a ultraviolet light absorber. For example, as these compounds, compounds containing a triazine skeleton may be used. Compounds described, for example, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, JP-T-8-501291 ("JP-T" means published searched patent publication), European Patent No. 711804A, and German Patent No. 19739797A, is preferable.

As fungiproofing/mildewproofing agents that can be used in the present invention, those described in JP-A-63-271247 are useful. As a hydrophilic colloid used in photographic layers that constitute the light-sensitive material, gelatin is preferable, and in particular, preferably heavy metals contained as impurities, such as iron, copper, zinc, and manganese are 5 ppm or less and more preferably 3 ppm or less.

Also, preferably calcium content in the light-sensitive material is 20 mg/m$^2$ or less, more preferably 10 mg/m$^2$ or less, most preferably 5 mg/m$^2$ or less.

The light-sensitive material of the present invention is for use in not only printing systems that use usual negative printers, it is also suitable for scanning exposure systems using cathode rays (CRT).

In comparison with apparatuses using lasers, cathode ray tube exposure apparatuses are simple and compact and make the cost low. Further, the adjustment of optical axes and colors is easy.

For the cathode ray tubes used for image exposure, use is made of various emitters that emit light in spectral regions as required. For example, any one of, or a mixture of two or more of, a red emitter, a green emitter, and a blue emitter may be used. In particular, a cathode ray tube that emits white light by mixing these phosphors is often used.

When the cathode ray tube has phosphors that show light emission in multiple spectral regions, multiple colors may be exposed at a time; namely, image signals of multiple colors are inputted into the cathode ray tube, to emit lights from the tube surface. A method in which exposure is made in such a manner that image signals for respective colors are inputted successively, to emit the respective colors successively, and they are passed through films for cutting out other colors (surface-successive exposure), may be employed, and generally the surface-successive exposure is preferred to make image quality high, since a high-resolution cathode ray tube can be used.

The light-sensitive material of the present invention is preferably used for digital scanning exposure system that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is preferable to use a semiconductor laser for at least one of the exposure light sources.

In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three wavelength regions, the blue region, the green region and the red region, to obtain an image.

If the exposure time in this scanning exposure is defined as the time for which a picture element size is exposed to light with the density of the picture element being 400 dpi, preferably the exposure time is $10^{-4}$ sec or less, more preferably $10^{-6}$ sec or less.

Preferable scanning exposure systems that can be applied to the present invention are described in detail in the patents listed in the above Table.

Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied. Further, as the preservative used for this developing solution, compounds described in the patents listed in the above Table are preferably used.

As the systems for conducting development of the light-sensitive material of the present invention after the exposure thereof, a wet system, such as the conventional method, in which development is carried out by using a developing solution containing an alkali agent and a developing agent, and a method in which a developing agent is built in the light-sensitive material and the development is carried out by using an activator solution, such as an alkali solution free from any developing agent, as well as a heat development system that does not use a processing solution, can be used. Particularly, since the activator method does not contain a developing agent in the processing solution, the control and the handling of the processing solution are easy, and the load at the time of waste liquor treatment is less, which makes the activator method preferable in view of environmental conservation.

In the activator method, as the developing agent or its precursor to be built in the light-sensitive material, for example, hydrazine-type compounds described in JP-A-8-234388, JP-A-9-152686, JP-A-9-152693, JP-A-9-211814, and JP-A-9-160193 are preferable.

Further, a development method in which the coated amount of silver in the light-sensitive material is decreased, and an image intensification processing (intensification processing) is carried out using hydrogen peroxide, is also preferably used. Particularly, it is preferable to use this method for the activator method. Specifically, preferably use is made of image-forming methods described in JP-A-8-297354 and JP-A-9-152695, wherein an activator solution containing hydrogen peroxide is used.

In the activator method, after the processing with an activator solution, a desilvering process is generally carried out, but in the image intensifying process in which a light-sensitive material with the amount of silver lowered is used, the desilvering process can be omitted, and a simple process, such as a washing process or a stabilizing process, can be carried out. Further, in a system in which image information is read from a light-sensitive material by a scanner or the like, a processing mode without requiring a desilvering process can be employed, even when a light-sensitive material having a large amount of silver, such as a light-sensitive material for shooting (photographing), is used.

As the processing materials and processing methods for the activator solution, the desilvering solution (bleach/fix solution), the washing water and the stabilizing solution that are used in the processing of the light-sensitive material of the present invention, known ones can be used. Preferably, those described in Research Disclosure Item 36544 (September 1994), pages 536 to 541, and JP-A-8-234388, can be used.

In the processing of the light-sensitive material of the present invention, the term "color-developing time" means a period of time required from the beginning of dipping of a light-sensitive material into a color developing solution until the light-sensitive material is dipped into a blix solution in the subsequent processing step. In the case where a processing is carried out using, for example, an autoprocessor, the color developing time is the sum total of a time in which a light-sensitive material has been dipped in a color developing solution (so-called "time in the solution") and a time in which the light-sensitive material after departure from the color developing solution has been conveyed in the air toward a bleach-fixing bath in the step subsequent to color development (so-called "time in the air"). Similarly the term "bleach-fixing time" means a period of time required from the beginning of dipping of a light-sensitive material into a bleach-fixing solution until the light-sensitive material is dipped into a washing or stabilizing bath in the subsequent processing step. Further, the term "washing or stabilizing time" means a period of time in which a light-sensitive material is staying in the washing or stabilizing solution until it begins to be conveyed toward a drying step (so-called "time in the solution").

The light-sensitive material of the present invention is preferably processed by rapid processing, and the color developing time is preferably 60 seconds or less, more preferably in the range of 50 seconds to 6 seconds. Similarly the bleach-fixing time is preferably 60 seconds or less, more preferably in the range of 50 seconds to 6 seconds. Further, the washing or stabilizing time is preferably 150 seconds or less, more preferably in the range of 130 seconds to 6 seconds.

As a drying method among the processing steps for the light-sensitive material of the present invention, any one of the methods which are conventionally known to dry color photographic light-sensitive materials rapidly may be adopted. From the object of the present invention, it is preferable to dry a color photographic light-sensitive material within 20 sec, more preferably within 15 sec, and most preferably in 5 sec to 10 sec.

As the drying system, any one of a contact heating system and a hot air-blowing system may be used, and a structure of a combination of the contact heating system and the hot air-blowing system makes it possible to carry out drying more rapidly than the above independent system, and the combination is hence preferable. In a more preferred embodiment concerning the drying method according to the present invention, the light-sensitive material is contact-heated using a heat-roller and then blow-dried using hot air blown toward the light-sensitive material from a perforated panel or nozzles. It is preferable that, in the blow-drying section, the mass velocity of the hot air blown per heat-receiving unit area of the light-sensitive material be 1000 $kg/m^2 \cdot hr$ or more. The diffuser (outlet of blown air) has preferably a shape reduced in pressure loss and examples of the shape are given in FIG. 7 to FIG. 15 described in JP-A-9-33998.

The silver halide color photographic light-sensitive material of the present invention provides the following excellent effects. Namely, the light-sensitive material is excellent in both a rapid processing suitability and a representation of the shading at the high density portion of the image obtained by a scanning exposure. In addition, a high quality of a color photographic image is also formed by a conventional surface exposure.

The silver halide color photographic light-sensitive material of the present invention provides an excellent effect on that a rapid processing suitability is excellent; the change in color balance at the peripheral portion of a color photograph obtained by a scanning exposure is restrained and a high maximum colored density is obtained by the scanning exposure; and in addition a high quality of a color photographic image is also formed by a conventional surface exposure.

The present invention will be described in more detail with reference to the following examples, but the present invention is not restricted to them.

EXAMPLES

EXAMPLE 1-1

Preparation of Emulsion

| | |
|---|---|
| Solution I | |
| Water | 1000 ml |
| Lime-processed gelatin | 58 g |
| NaCl | 63 mmol |
| pH (adjusted by using sulfuric acid) | 2.9 |
| Solution II | |
| Silver nitrate | 1.70 mol |
| Water to make | 617 ml |
| Solution III | |
| NaCl | 1.80 mol |
| Water to make | 617 ml |

-continued

| | |
|---|---|
| Solution IV | |
| Silver nitrate | 0.42 mol |
| Water to make | 200 ml |
| Solution V | |
| NaCl | 0.042 mol |
| KBr | 4.2 mmol |
| Potassium hexacyano ferrate (II) trihydrate | 0.06 mmol |
| Water to make | 200 ml |

To the Solution I kept at 50 ° C., the Solutions II and III were added at the same time while vigorously stirring (addition rate of Solution II: 6.2 ml/min, addition rate of Solution III: 6.9 ml/min). In twenty two minutes and thirty seconds after the addition started, addition rates of both the Solutions II and III were increased, and while accelerating the addition rates, a total amount of each of the Solutions II and III was added over 53 minutes after the beginning of addition. Further, a total amount of each of the Solutions IV and V was added over 12 minutes while vigorously stirring. The resulting mixture, after keeping at 50° C. for 10 minutes, was cooled and then subjected to desalting, sedimentation and washing with water. Further, after elevating the temperature to 50° C., 170 g of a lime-processed gelatin was added and the gelatin mixture was adjusted so as to become pH of 5.3 and pAg of 7.5. To the resulting emulsion, 0.04 mmole of sodium benzenethiosulfate, 0.03 mmole of Red-sensitive sensitizing dye G, 0.015 mmole of chloroauric acid, 0.2 mmole of potassium thiocyanate and 0.006 mmole of triethyl thiourea were added in order, per mole of silver respectively. Once the temperature of the mixture was elevated to 70° C. and then cooled to 50° C. Thereafter, 1.7 mmole of silver chlorobromide fine grains (Br 60 mole %, potassium hexachloroiridate (IV) was doped), 7.1 mmole of silver chlorobromide fine grains (Br 30 mole %), 0.2 mmole of 1-(3-methylureidophenyl)-5-mercaptotetrazole, 0.2 mmol of 1-phenyl-5-mercaptotetrazole, and 1.5 mmole of KBr were added in the above order, to prepare a red-sensitive emulsion 1-R1. The red-sensitive emulsion 1-R1 was a high silver chloride cubic emulsion having the following characteristics: the side length of grains: 0.41 μm, coefficient of variation of the grain size: 0.09, and the bromide content: 0.66 mole %.

Sensitizing Dye for Red-sensitive Emulsion Layer

Sensitizing dye G

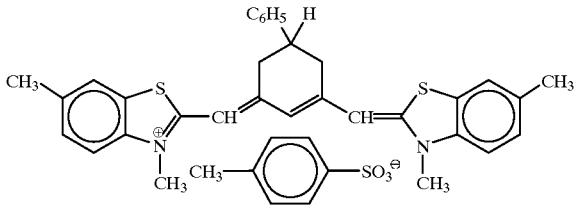

(It was used in an amount of $3\times10^{-5}$ mole/mole of silver halide to the red-sensitive emulsion 1-R1, and in an amount of $3.5\times10^{-5}$ mole/mole of silver halide to the red-sensitive emulsion 1-R1')

Red-sensitive emulsions 1-R2 to 1-R4 were prepared in the same manner as the emulsion 1-R1, except that the amount of potassium hexachloroiridate (IV) in the silver chlorobromide fine grains and the coefficient of variation of the grain size were altered as shown in Table 3. Further, the emulsion 1-R1'as described below was prepared in the same manner as the emulsion 1-R1, except that the temperature of Solution I and addition rates of the Solutions II to V were altered, and further the amounts of chemicals to be added after the pAg adjustment were changed. Namely, the emulsion 1-R1' was a high silver chloride cubic emulsion having the following characteristics: the side length of grains: 0.34 μm, coefficient of variation of the grain size: 0.08, and the bromide content: 0.80 mole %. Red-sensitive emulsions 1-R2' to 1-R4' were prepared in the same manner as the emulsion 1-R1', except that the amount of potassium hexachloro iridate (IV) in the silver chlorobromide fine grains and the grain size and the coefficient of variation of the grain size were altered as shown in Table 3. The grain size, the coefficient of variation of the grain size and the iridium content of each of these emulsions are shown in Table 3.

TABLE 3

| Name of red-sensitive emulsion | Grain size (Side length, μm) | Coefficient of variation of grain size | Iridium content (mol/Ag mol) |
|---|---|---|---|
| 1-R1 | 0.41 | 0.09 | $41.0\times10^{-7}$ |
| 1-R2 | 0.41 | 0.08 | $2.2\times10^{-7}$ |
| 1-R3 | 0.41 | 0.09 | $3.4\times10^{-7}$ |
| 1-R4 | 0.41 | 0.09 | $4.4\times10^{-7}$ |
| 1-R1' | 0.34 | 0.08 | $1.0\times10^{-7}$ |
| 1-R2' | 0.35 | 0.08 | $2.0\times10^{-7}$ |
| 1-R3' | 0.34 | 0.09 | $4.4\times10^{-7}$ |
| 1-R4' | 0.34 | 0.08 | $4.9\times10^{-7}$ |

Blue-sensitive emulsions 1-B1 and 1-B1', and green-sensitive emulsions 1-G1 and 1-G1' were prepared in the same manner as the red-sensitive emulsion 1-R1, except that the temperature of Solution I and the addition rates of the Solutions II to V were altered, and the amount of potassium hexacyano ferrate(II) in the Solution V was altered, the amounts of both chemicals to be added after the pAg adjustment and potassium hexachloroiridate (IV) in the silver chlorobromide fine grains were altered, and further Blue-sensitive sensitizing dyes A, B and C, or Green-sensitive sensitizing dyes D, E and F were added in place of the Red-sensitive sensitizing dye G, respectively.

Sensitizing Dye for Blue-Sensitive Emulsion Layer

Sensitizing dye A

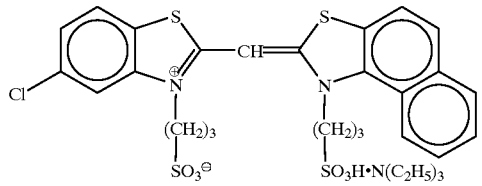

Sensitizing dye B

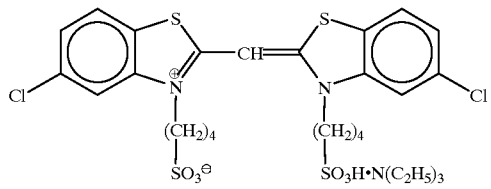

-continued

Sensitizing dye C

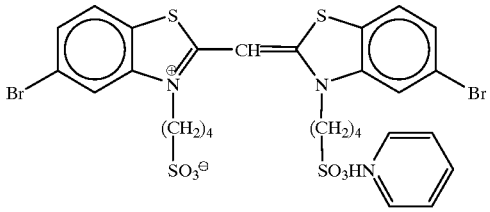

(To a large-size emulsion 1-B1, was used the blue-sensitive sensitizing dyes A, B, and C in amounts of $2.2\times10^{-4}$ mol, $3.0\times10^{-5}$ mol, and $1.8\times10^{-4}$ mol, per mol of the silver halide, respectively, and to a small-size emulsion 1-B1', was used the blue-sensitive sensitizing dyes A, B, and C in amounts of $2.5\times10^{-}$mol, $3.4\times10^{5}$ mol, and $2.1\times10^{-4}$ mol, per mol of the silver halide, respectively.)

Sensitizing Dye for Green-Sensitive Emulsion Layer

Sensitizing dye D

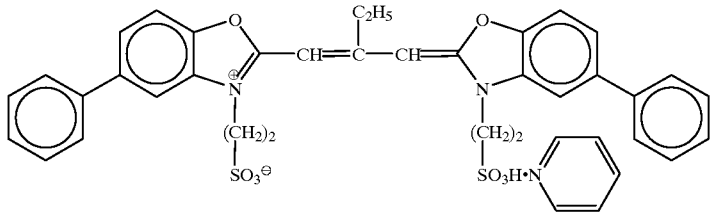

Sensitizing dye E

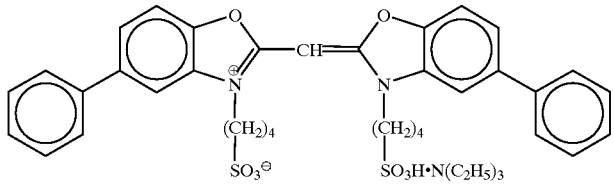

Sensitizing dye F

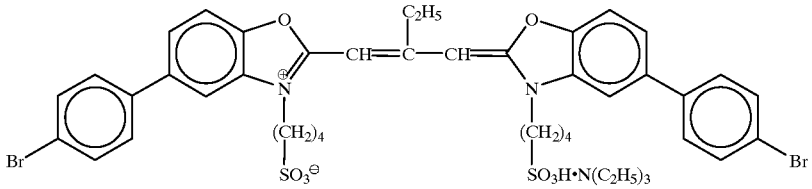

(To a large-size emulsion 1-G1, was used the green-sensitive sensitizing dyes D, E, and F in amounts of $3.0\times10^{-4}$ mol, $6.0\times10^{-5}$ mol, and $1.0\times10^{-5}$ mol, per mol of the silver halide, respectively, and to a small-size emulsion 1-G1', was used the green-sensitive sensitizing dyes D, E, and F in amounts of $3.7\times10^{-4}$ mol, $7.4\times10^{-5}$ mol, and $1.2\times10^{-5}$ mol, per mol of the silver halide, respectively.)

Preparation of Samples (1101) to (1108)

A surface of a paper support laminated on both sides with polyethylene was corona discharged. The support was provided with a gelatin subbing layer containing sodium dodecylbenzenesulfonate, and various photographic constitutional layers described below were coated, to prepare Sample (1101). To the polyethylene laminate layer at the photographic constituent layer-coating side, 3 mg/m$^2$ of K-1, 12 mg/m$^2$ of K-2 and 14% by mass of titanium oxide were added.

(K-1)

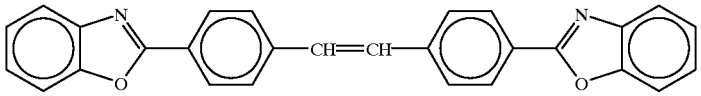

(K-2)

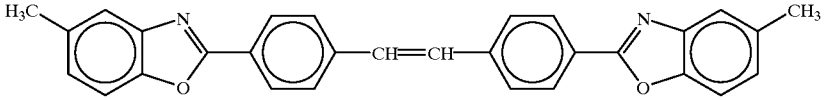

(Layer Constitution)

The composition of each layer is shown below. The numbers show coating amounts (g/m$^2$). In the case of the silver halide emulsion, the coating amount is in terms of silver.

| | |
|---|---|
| First Layer (Blue-Sensitive Emulsion Layer) | |
| A silver chlorobromide emulsion (Cubes, a mixture of a large-size emulsion 1-B1 having an average grain size of 0.71 μm, and a small-size emulsion 1-B1' having an average grain size of 0.62 μm (3:7 in terms of mol of silver). The deviation coefficients of the grain size distributions were 0.08 and 0.10, respectively, and each emulsion had 0.28 mol % and 0.33 mol %, respectively, of a silver bromide locally contained in part of the grain surface whose substrate was made of silver chloride.) | 0.25 |
| Gelatin | 1.35 |
| Yellow coupler (ExY-1) | 0.41 |
| Yellow coupler (ExY-2) | 0.21 |
| Color-image stabilizer (Cpd-1) | 0.08 |
| Color-image stabilizer (Cpd-2) | 0.04 |
| Color-image stabilizer (Cpd-3) | 0.08 |
| Color-image stabilizer (Cpd-8) | 0.04 |
| Solvent (Solv-1) | 0.23 |
| Second Layer (Color-Mixing Inhibiting Layer) | |
| Gelatin | 0.95 |
| Color-mixing inhibitor (Cpd-4) | 0.12 |
| Color-image stabilizer (Cpd-6) | 0.007 |
| Color-image stabilizer (Cpd-7) | 0.14 |
| Color-image stabilizer (Cpd-13) | 0.006 |
| Solvent (Solv-1) | 0.06 |
| Solvent (Solv-2) | 0.22 |
| Third Layer (Green-Sensitive Emulsion Layer) | |
| A silver chlorobromide emulsion (Cubes, a mixture of a large-size emulsion 1-G1 having an average grain size of 0.42 μm, and a small-size emulsion 1-G1' having an average grain size of 0.33 μm (3:7 in terms of mol of silver). The deviation coefficients of the grain size distributions were 0.10 and 0.08, respectively, and each emulsion had 0.69 mol % and 0.81 mol %, respectively, of a silver bromide locally contained in part of the grain surface whose substrate was made up of silver chloride.) | 0.12 |
| Gelatin | 1.20 |
| Magenta coupler (ExM-1) | 0.10 |
| Magenta coupler (ExM-2) | 0.05 |
| Ultraviolet absorbing agent (UV-1) | 0.05 |
| Ultraviolet absorbing agent (UV-2) | 0.02 |
| Ultraviolet absorbing agent (UV-3) | 0.02 |
| Ultraviolet absorbing agent (UV-4) | 0.03 |
| Color-image stabilizer (Cpd-2) | 0.005 |
| Color-image stabilizer (Cpd-4) | 0.002 |
| Color-image stabilizer (Cpd-7) | 0.08 |
| Color-image stabilizer (Cpd-8) | 0.015 |
| Color-image stabilizer (Cpd-9) | 0.03 |
| Color-image stabilizer (Cpd-10) | 0.01 |
| Color-image stabilizer (Cpd-11) | 0.0001 |
| Color-image stabilizer (Cpd-13) | 0.004 |
| Solvent (Solv-3) | 0.10 |
| Solvent (Solv-4) | 0.19 |
| Solvent (Solv-5) | 0.17 |
| Fourth Layer (Color-Mixing Inhibiting Layer) | |
| Gelatin | 0.71 |
| Color-mixing inhibitor (Cpd-4) | 0.09 |
| Color-image stabilizer (Cpd-6) | 0.005 |
| Color-image stabilizer (Cpd-7) | 0.10 |
| Color-image stabilizer (Cpd-13) | 0.004 |
| Solvent (Solv-1) | 0.04 |
| Solvent (Solv-2) | 0.16 |
| Fifth Layer (Red-Sensitive Emulsion Layer) | |
| A silver chlorobromide emulsion (Cubes, a mixture of a large-size emulsion 1-R1 having an average grain size of 0.41 μm, and a small-size emulsion 1-R1' having an average grain size of 0.34 μm (6:4 in terms of mol of silver). The deviation coefficients of the grain size distributions were 0.09 and 0.08, respectively.) | 0.18 |
| Gelatin | 1.00 |
| Cyan coupler (ExC-1) | 0.05 |
| Cyan coupler (ExC-2) | 0.18 |
| Cyan coupler (ExC-3) | 0.024 |
| Ultraviolet absorbing agent (UV-1) | 0.04 |
| Ultraviolet absorbing agent (UV-3) | 0.01 |
| Ultraviolet absorbing agent (UV-4) | 0.01 |
| Color-image stabilizer (Cpd-1) | 0.23 |
| Color-image stabilizer (Cpd-9) | 0.01 |
| Color-image stabilizer (Cpd-12) | 0.01 |
| Color-image stabilizer (Cpd-13) | 0.006 |
| Solvent (Solv-6) | 0.23 |
| Sixth Layer (Ultraviolet Absorbing Layer) | |
| Gelatin | 0.34 |
| Ultraviolet absorbing agent (UV-1) | 0.08 |
| Ultraviolet absorbing agent (UV-2) | 0.03 |
| Ultraviolet absorbing agent (UV-3) | 0.03 |
| Ultraviolet absorbing agent (UV-4) | 0.02 |
| Ultraviolet absorbing agent (UV-5) | 0.01 |
| Ultraviolet absorbing agent (UV-6) | 0.03 |
| Solvent (Solv-7) | 0.10 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-14) | 0.01 |
| Surface-active agent (Cpd-15) | 0.01 |

(ExY-1) Yellow coupler

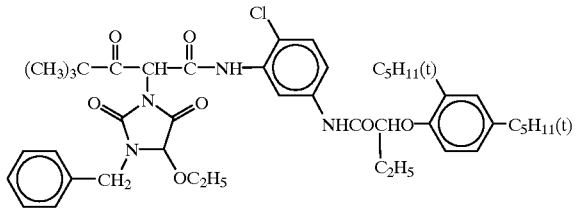

(ExY-2) Yellow coupler

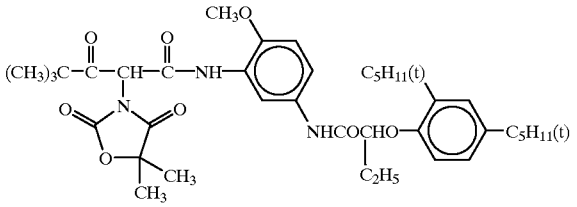

(ExM-1) Magenta coupler

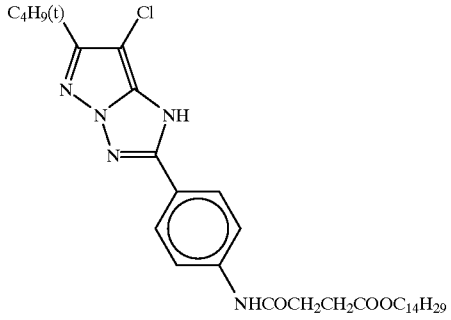

-continued (ExM-2) Magenta coupler

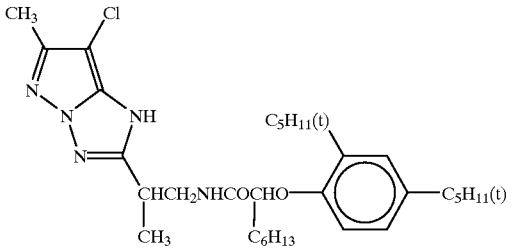

(ExC-1) Cyan coupler

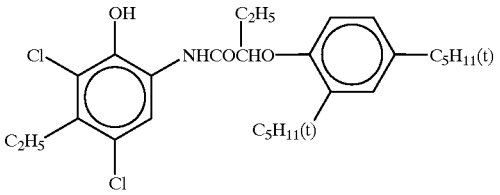

(ExC-2) Cyan coupler

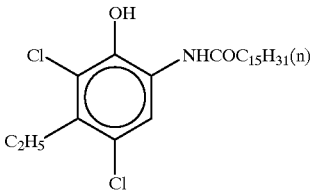

(ExC-3) Cyan coupler

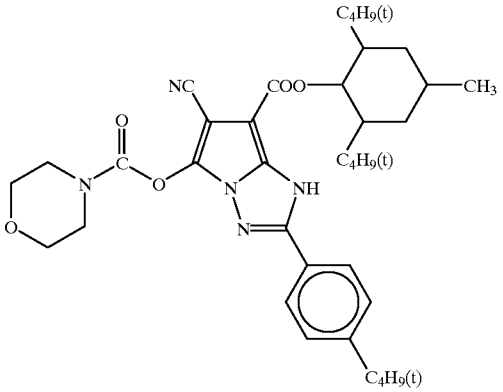

(Cpd-1) Color-image stabilizer

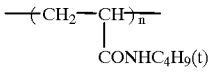

number average
molecular weight 60,000

(Cpd-2) Color-image stabilizer

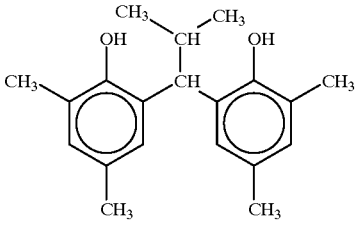

-continued (Cpd-3) Color-image stabilizer

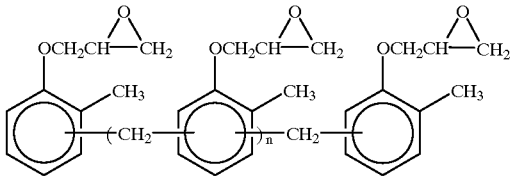

n = 7~8 (average)

(Cpd-4) Color-mixing inhibitor

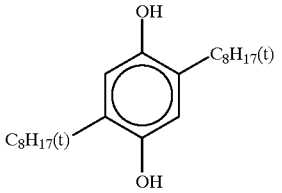

(Cpd-5) Color-mixing inhibitor

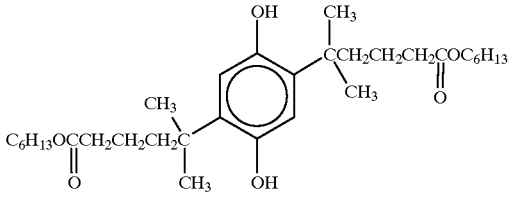

(Cpd-6) Color-mixing inhibiting auxiliary

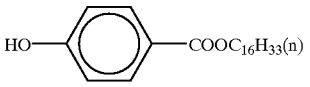

(Cpd-7) Stabilizer

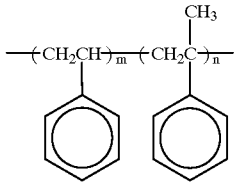

number average
molecular weight 600
m/n = 10/90

(Cpd-8) Color-image stabilizer

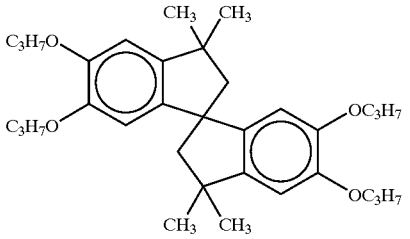

-continued
(Cpd-9) Color-image stabilizer
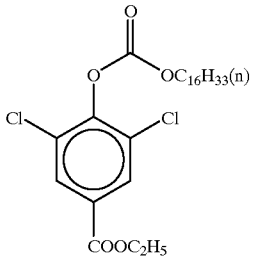
(Cpd-10) Color-image stabilizer
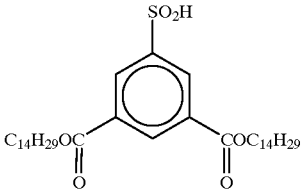
(Cpd-11)
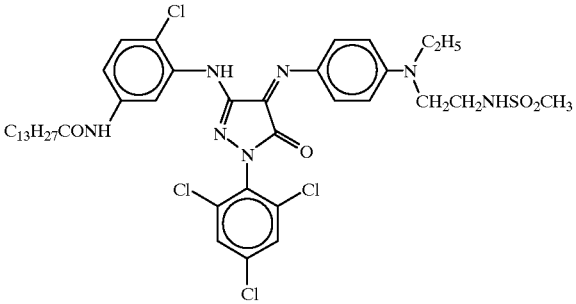
(Cpd-12) Color-image stabilizer
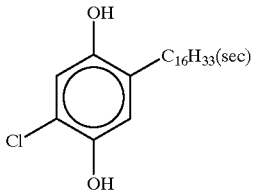
(Cpd-13) Color-image stabilizer
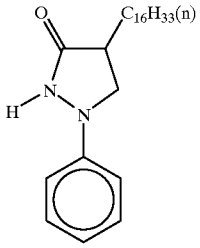
(Cpd-14) Surfactant
A mixture of 7:3 (weight ratio) of
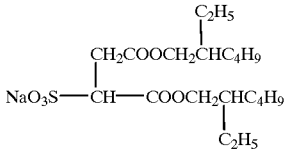
and
-continued
(Cpd-15) Surfactant
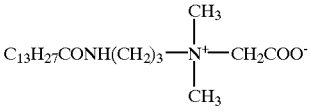
(UV-1) Ultra-violet absorbent
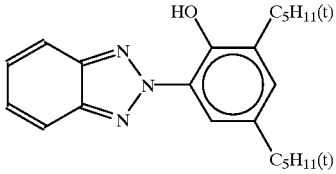
(UV-2) Ultra-violet absorbent
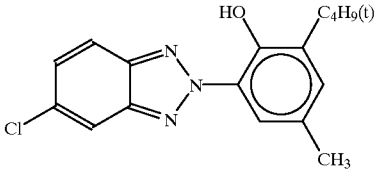
(UV-3) Ultra-violet absorbent
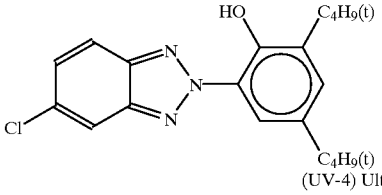
(UV-4) Ultra-violet absorbent
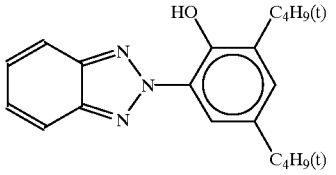
(UV-5) Ultra-violet absorbent
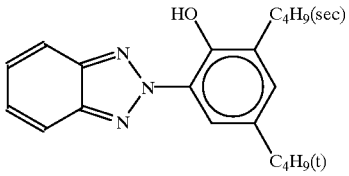
(UV-6) Ultra-violet absorbent
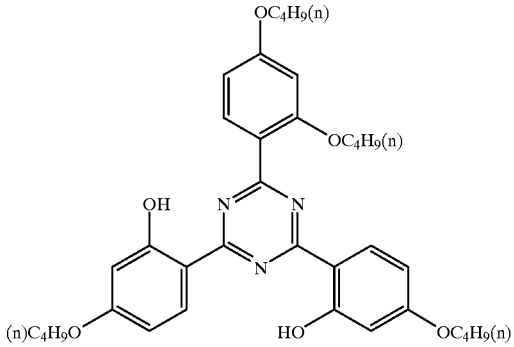

(Solv-1)

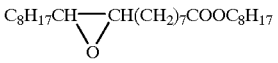

(Solv-2)

A mixture in 1:1 (weight ratio) of

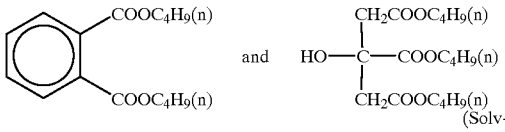

(Solv-3)

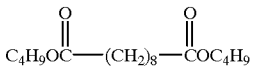

(Solv-4)

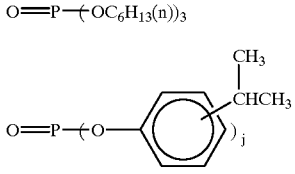

(Solv-5)

A mixture in 1:1 (weight ratio) of

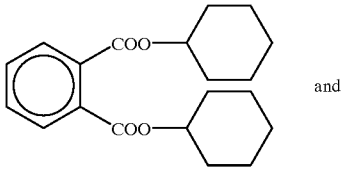

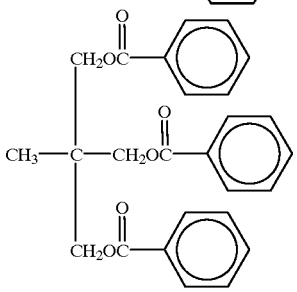

(Solv-6)

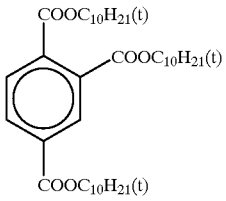

(Solv-7)

Further, the following Compound I was added to the red-sensitive emulsion layer, in an amount of $2.6\times10^{-3}$ mol, per mol of the silver halide.

(Compound I)

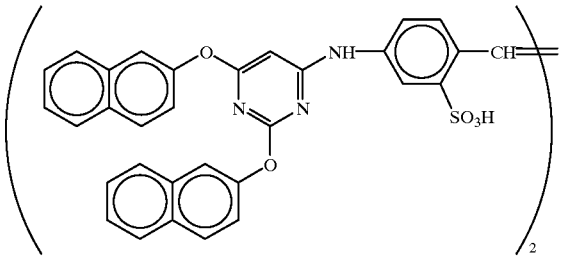

Further, to the blue-sensitive emulsion layer, the green-sensitive emulsion layer, and the red-sensitive emulsion layer, was added 1-(3-methylureidophenyl)-5-mercaptotetrazole in amounts of $3.3\times10^{-4}$ mol, $1.0\times10^{-3}$ mol, and $5.9\times10^{-4}$ mol, per mol of the silver halide, respectively.

Further, to the second layer, the fourth layer, the sixth layer, and the seventh layer, it was added in amounts of 0.2 mg/m$^2$, 0.2 mg/m$^2$, 0.6 mg/m$^2$ , and 0.1 mg/m$^2$ respectively.

Further, to the blue-sensitive emulsion layer and the green-sensitive-emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

To the red-sensitive emulsion layer, was added a copolymer of methacrylic acid and butyl acrylate (1:1 in weight ratio; average molecular weight, 200,000 to 400,000) in an amount of 0.05g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, to neutralize irradiation, the following dyes were added to the emulsion layers (the coating amount is shown in parentheses).

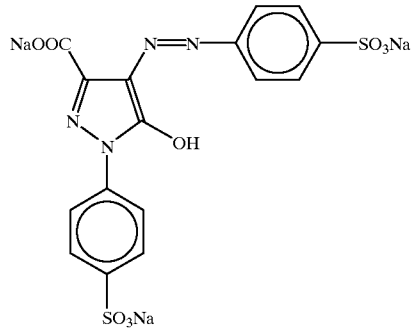

(2 mg/m$^2$)

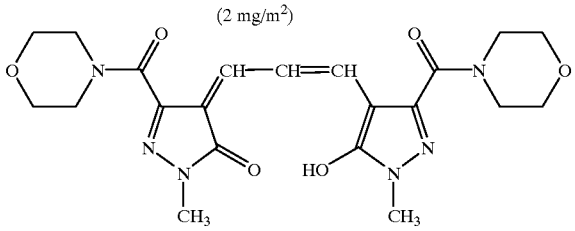

(5 mg/m$^2$)

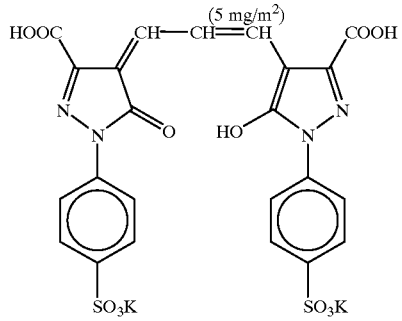

(1 mg/m$^2$)

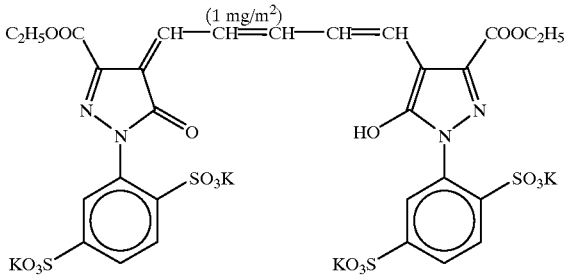

(20 mg/m$^2$)

-continued

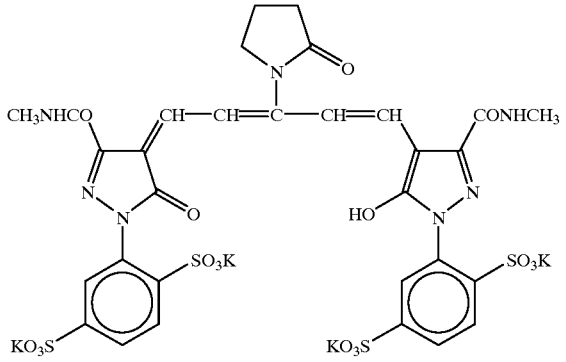

(10 mg/m$^2$)

Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(Ab-1) Antiseptic

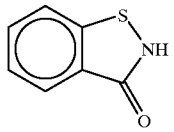

(Ab-2) Antiseptic

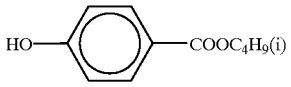

(Ab-3) Antiseptic

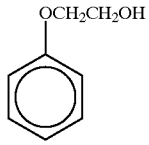

(Ab-4) Antiseptic

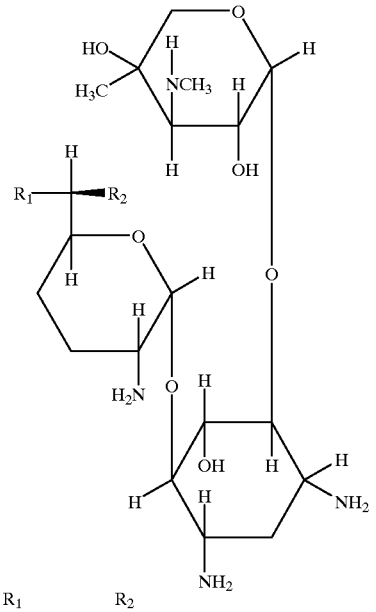

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c, d

Sodium 1-oxi-3,5-dichloro-s-triazine was used as gelatin hardener of each layer.

Samples (1102) to (1108) were prepared in the same manner as the Sample (1101), except for changing the red-sensitive emulsion of the fifth layer to emulsions described in Table 4.

TABLE 4

| Name sample | Red-sensitive emulsion High-sensitivity emulsion/ Low-sensitivity emulsion |
|---|---|
| 1101 | 1-R1/1-R1' |
| 1102 | 1-R2/1-R2' |
| 1103 | 1-R3/1-R2' |
| 1104 | 1-R4/1-R2' |
| 1105 | 1-R2/1-R3' |
| 1106 | 1-R3/1-R3' |
| 1107 | 1-R3/1-R4' |
| 1108 | 1-R4/1-R4' |

To the Sample (1101), the following exposure to light and processing were carried out. The Sample 1101 was subjected to gradation exposure to light for sensitometry through through a red filter, using a sensitometer (FWH type, manufactured by Fuji Photo Film Co., Ltd.; color temperature of the light source: 3,200° K.). This exposure was carried out such that the exposure amount would be 250 lux•sec (lx•sec) with the exposure time of $10^{-1}$ sec. Then, the sample further was processed as follows.

| Processing step | Temperature | Time | Replenishment rate* |
|---|---|---|---|
| Color development | 38.5° C. | 45 sec | 45 ml |
| Bleach-fix | 38.0° C. | 45 sec | 35 ml |
| Rinse (1) | 38.0° C. | 15 sec | — |
| Rinse (2) | 38.0° C. | 15 sec | — |
| Rinse (3) | **38.0° C. | 15 sec | — |
| Rinse (4) | **38.0° C. | 20 sec | 121 ml |

*Replenishment rates were amounts pe m$^2$ of the light-sensitive material processed.

**A Rinse Cleaning System RC50D, trade name, manufactured by Fuji Photo Film Co., Ltd., was installed in a rinse (3), and the rinse solution was taken out from the rinse (3), and was pumped to a reserve osmosis membrane module (RC50D) by a pumped. The permeated water obtained in the tank was fed to a rinse (4), and the concentrated water was returned to the rinse (3). The pump pressure was adjusted so that the amount of permeated water to the reserve osmosis membrane module would kept at 50 to 300 ml/min, and circulation was conducted for 10 hours per day, with the temperature controlled. (The rinse was of a tank counter-current system from the tank (1) to the tank (4).

The compositions of the processing solutions were as follows.

| | Tank Solution | Replenisher |
|---|---|---|
| [Color Developer] | | |
| Water | 800 ml | 800 ml |
| Dimethylpolysiloxane-series surface active agent (Silicone KF351A, trade name: manufactured by Shinetsu Kagaku Kogyo Co.) | 0.1 g | 0.1 g |
| Tri(isopropanol)amine | 8.8 g | 8.8 g |
| Ethylenediaminetetraacetic | 4.0 g | 4.0 g |
| Polyethylene glycol (MW 300) | 10.0 g | 10.0 g |

-continued

| | Tank Solution | Replenisher |
|---|---|---|
| Sodium 4,5-dihydrobenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hakkol FWA-SF, trade name: manufactured by Showa Kagayu Co.) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-Ethyl-N-(β-methanesulfonamidoethyl)-3-methyl-4-aminoaniline 3/2 sulfuric acid monohydrate | 5.0 g | 15.7 g |
| Potassium carbonate | 26.3 g | 26.3 g |
| Water to make | 1000 ml | 1000 ml |
| pH (adjusted by using potassium hydroxide and sulfuric acid at 25° C.) | 10.15 | 12.50 |
| [Breach-Fixing Solution] | | |
| Water | 700 ml | 600 ml |
| Ethylenediaminetetraacetate (III) ammonium | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 ml | 214.0 ml |
| Ammonium sulfite | 16.0 g | 32.0 g |
| Potassium bisulfite | 23.1 g | 46.2 g |
| Water to make | 1000 ml | 1000 ml |
| pH (adjusted by using acetic acid and ammonium at 25° C.) | 6.0 | 6.0 |
| [Rinse Solution] | | |
| Sodium chlorinated-isocyanurate | 0.02 g | 0.02 g |
| Deionized water (having a conductivity of 5 μS/cm or below) | 1000 ml | 1000 ml |
| pH | 6.5 | 6.5 |

A colored density of the Sample (1101) processed as described above was measured, and sensitometry corresponding to the red-sensitive cyan-color forming layer was conducted to obtain a characteristic curve. As to the thus-obtained characteristic curve, an exposure amount required to provide the density of [a density at the unexposed portion +0.02] was read. Thereafter, color density (i.e., D1) obtained by an exposure with an exposure amount 10 times the thus-read exposure amount, was measured respectively.

Further, Sample (1101) was subjected to a gradation exposure for sensitometry through a red filter using a sensitometer (Model HIE, manufactured by Fuji Photo Film Co., Ltd.) for $10^{-4}$ sec of exposure time, and processed with the above processing. A color density of the processed Sample (1101) was measured, and sensitometry for $10^{-4}$ sec exposure corresponding to the red-sensitive cyan-coloring layer was conducted to obtain a characteristic curve. As to the characteristic curve obtained, color density (D1') was obtained in the same manner as shown above. As to the characteristic curve obtained by a $10^{-4}$ sec exposure, an exposure amount (E1) required to provide the density of [a density at the unexposed portion +0.02] was read. Further, the exposure amount (E2) required to provide the density 0.92 times the maximum color-density in the characteristic curve obtained by a $10^{-1}$ sec exposure, was measured in the characteristic curve obtained by a $10^{-4}$ sec exposure. In this connection, the above-mentioned sensitometer Model HIE was a sensitometer designed so that a strong intensity of illumination from a light source could be provided to obtain an exposure amount required in a short time.

A negative image was obtained by photographing a woman wearing a red dress using NEXIAH 400 (trade name, a negative film manufactured by Fuji Photo Film Co., Ltd.), followed by a processing of the film. Samples (1101) to (1108) were subjected to a surface exposure through the negative obtained by means of SUPER FA-238 (trade name, a minilab manufactured by Fuji Photo Film Co., Ltd.), followed by a processing, to thereby obtain a color print image due to a surface exposure. On the other hand, the above-obtained negative information was digitalized by means of FRONTIER 350 (trade name, a digital minilab manufactured by Fuji Photo Film Co., Ltd.; output scale: $10^{-7}$ sec per pixel (image element), blue light 40 μW, green light 300 μW, red light 2 mW). Based on the information, the Samples (1101) to (1108) were subjected to a scanning exposure while modulating so as to vary the quantity of light from each laser light source, followed by a processing, to thereby obtain a color print image due to a scanning exposure.

The photographic property difference between the image obtained by the scanning exposure which was a high illumination intensity short time exposure, and that due to a conventional surface exposure was evaluated, in terms of D1'/D1, log(E2/E1) and the print images obtained by the above-mentioned techniques.

Each of the color print image obtained by subjecting the Samples (1101) to (1108) to a surface exposure was excellent. As is apparent from the results shown in Table 5, each of images obtained by subjecting the Samples (1101) to (1104) and (1108) to a scanning exposure provided unsatisfactory reproduction of the shading of the red dress. In contrast, each of images obtained by subjecting the Samples (1105) to (1107), in which the values of D1'/D1and log(E2/E1) were within the range defined by the present invention, to a scanning exposure, provided an excellent reproduction of the shading of the red dress.

TABLE 5

| Name of sample | D1'/D1 | log (E1/E2) | Reproduction of Shading owing to Scanning Exposure | Remarks |
|---|---|---|---|---|
| 1101 | 0.60 | 1.71 | Lack of conciseness of the shading, and no sense of depth | Comparative example |
| 1102 | 0.66 | 1.65 | Lack of conciseness of the shading, and no sense of depth | Comparative example |
| 1103 | 0.83 | 1.58 | Lack of conciseness of the shading, and no sense of depth | Comparative example |
| 1104 | 0.88 | 1.45 | Large portion of a pale shading, and unnatural, and also unsatisfactory conciseness of the shading | Comparative example |
| 1105 | 0.65 | 1.36 | Natural shading, and excellent | This invention |
| 1106 | 0.77 | 1.29 | Natural shading and good conciseness of the shading, and more excellent | This invention |
| 1107 | 0.85 | 1.12 | Slightly strong shading, but still excellent | This invention |
| 1108 | 0.98 | 1.08 | Strong conciseness of the shading, and unnatural | Comparative example |

Example 1-2

Red-sensitive emulsions 1-R5 and 1-R5' were prepared in the same manner as the foregoing Red-sensitive emulsions 1-R3 and 1-R3', respectively, except that potassium hexacyano ferrate (II) in the Solution V was omitted, and the amounts of both chloroauric acid and triethylthiourea to be added were changed so as to optimally conduct a chemical sensitization.

Further, Red-sensitive emulsions 1-R6 and 1-R6' were prepared in the same manner as the foregoing Red-sensitive emulsions 1-R5 and 1-R5', except that potassium hexacyano ferrate (II) was added to the Solution V in amounts of 0.03 mmole and 0.05 mmole, respectively.

In order to evaluate production stability of the Red-sensitive emulsions 1-R5, 1-R5', 1-R6 and 1-R6', each of these emulsions was prepared three times. In Table 6, preparation numbers are indicated as #1 to #3.

Samples (1201) to (1206) were prepared in the same manner as Sample (1101), except that the red-sensitive emulsion to be used therein was altered to the Red-sensitive emulsion 1-R5, 1-R5', 1-R6 or 1-R6', as indicated in Table 6, respectively.

The Samples (1201) to (1206) were also evaluated in the same manner as in Example 1-1.

Similarly to Example 1-1, each color print image obtained by subjecting the Samples (1201) to (1206) according to the present invention to a conventional surface exposure was excellent. In addition, the reproduction of the shading on the red dress of the image obtained by subjecting them to scanning exposure, was also excellent respectively. It is apparent from the results shown in Table 6 that the Samples (1204) to (1206), in each of which two kinds of complexes of metals of the group VIII of the periodic table were contained in a red-sensitive emulsion, provided a more stable performance in the repetition of the emulsion production, as compared to the Samples (1201) to (1203), in each of which only one kind of the complex of metal of the group VIII of the periodic table was contained in a red-sensitive emulsion.

In this Example, when an image was obtained by subjecting the Samples (1201) to (1203) to a scanning exposure, gradation retouch by means of a calibration function mounted on the digital mini-lab, was needed in every time for each of these samples in order to harmonize the color balance of the finished image. On the other hand, in the case where the Samples (1204) to (1206) were used, once the calibration was conducted with any one of these samples, a satisfactory image was obtained in every sample of Samples (1204) to (1206). It is also apparent from the above-mentioned results that the Samples (1204) to (1206) are excellent and more preferable in the productivity.

TABLE 6

| Name of sample | Red-sensitive emulsion High-sensitivity emulsion/Low-sensitivity emulsion | D1'/D1 | log (E1/E2) | Remarks |
|---|---|---|---|---|
| 1201 | 1-R5#1/1-R5'#1 | 0.68 | 1.34 | This invention |
| 1202 | 1-R5#2/1-R5'#2 | 0.71 | 1.25 | This invention |
| 1203 | 1-R5#3/1-R5'#3 | 0.76 | 1.28 | This invention |
| 1204 | 1-R6#1/1-R6'#1 | 0.71 | 1.28 | This invention |
| 1205 | 1-R6#2/1-R6'#2 | 0.70 | 1.27 | This invention |

TABLE 6-continued

| Name of sample | Red-sensitive emulsion High-sensitivity emulsion/Low-sensitivity emulsion | D1'/D1 | log (E1/E2) | Remarks |
|---|---|---|---|---|
| 1206 | 1-R6#3/1-R6'#3 | 0.72 | 1.27 | This invention |

Example 2-1

Preparation of Emulsion

| | | |
|---|---|---|
| Solution I | | |
| Water | 1000 | ml |
| Lime-processed gelatin | 58 | g |
| NaCl | 63 | mmol |
| pH (adjusted by using sulfric acid) | 2.9 | |
| Solution II | | |
| Silver nitrate | 1.70 | mol |
| Water to make | 617 | ml |
| Solution III | | |
| NaCl | 1.80 | mol |
| Water to make | 617 | ml |
| Solution IV | | |
| Silver nitrate | 0.42 | mol |
| Water to make | 200 | ml |
| Solution V | | |
| NaCl | 0.42 | mol |
| KBr | 4.2 | mmol |
| Potassium hexacyano ferrate (II) trihydrate | 0.015 | mmol |
| Water to make | 200 | ml |

To the Solution I kept at 49° C., Solutions II and III were added at the same time while vigorously stirring (addition rate of Solution II: 6.2 ml/min, addition rate of Solution III: 6.9 ml/min). In twenty two minutes and thirty seconds after the addition started, addition rates of both the Solutions II and III were increased, and while accelerating the addition rates, a total amount of each of the Solutions II and III was added over 53 minutes after the beginning of addition. Further, a total amount of each of the Solutions IV and V was added over 12 minutes while vigorously stirring. The resulting mixture, after keeping at 50° C. for 10 minutes, was cooled and then subjected to desalting, sedimentation and washing with water. Further, after elevating the temperature to 50° C., 170 g of a lime-processed gelatin was added and the gelatin mixture was adjusted so as to become pH of 5.3 and pAg of 7.5. To the resulting emulsion, 0.04 mmole of sodium benzenethiosulfate, 0.032 mmole of the above-mentioned Red-sensitive sensitizing dye G, 0.016 mmole of chloroauric acid, 0.21 mmole of potassium thiocyanate and 0.006 mmole of triethyl thiourea were added in the above order, per mole of silver respectively. Once the temperature of the mixture was elevated to 70° C. and then cooled to 50° C. Thereafter, 1.8 mmole of silver chlorobromide fine grains (Br 60 mole %, potassium hexachloroiridate (IV) was doped), 6.8 m mole of silver chlorobromide fine grains (Br 30 mole %), 0.21 mmole of 1-(3-methylureidophenyl)-5-mercaptotetrazole and 1.6 mmole of KBr were added in the above order, to prepare Red-sensitive emulsion 2-R1. The Red-sensitive emulsion 2-R1 was a high silver chloride cubic emulsion having the following characteristics: the side length of grains: 0.40 μm, coefficient of variation of the grain size: 0.09, and the bromide content: 0.67 mole %.

Sensitizing Dye for Red-Sensitive Emulsion Layer

The above-mentioned Red-sensitive sensitizing dye G was used.

(It was added in an amount of $3.2\times10^{-5}$ mole/mole of silver halide to the Red-sensitive emulsion 2-R1, and in an amount of $3.7\times10^{-5}$ mole/mole of silver halide to the Red-sensitive emulsion 2-R1')

Red-sensitive emulsions 2-R2 to 2-R4 were prepared in the same manner as the Red-sensitive emulsion 2-R1, except that the amount of potassium hexachloroiridate (IV) in the silver chlorobromide fine grains and the coefficient of variation of the grain size were altered, as shown in Table 7. Further, Red-sensitive emulsion 2-R1' as described below was prepared in the same manner as the Red-sensitive emulsion 2-R1, except that the temperature of Solution I and addition rates of the Solutions II to V were altered, and further the amount of chemicals to be added after the pAg adjustment was changed. Namely, the Red-sensitive emulsion 2-R1' was a high silver chloride cubic emulsion having the following characteristics: the side length of grains: 0.34 μm, coefficient of variation of the grain size: 0.08, and the bromide content: 0.80 mole %. Red-sensitive emulsions 2-R2' to 2-R4' were prepared in the same manner as the Red-sensitive emulsion 2-R1', except that the amount of potassium hexachloro iridate (IV) in the silver chlorobromide fine grains and the grain size and the coefficient of variation of the grain size were altered, as shown in Table 7. The grain size, the coefficient of variation of the grain size and the iridium content of each of these emulsions are shown in Table 7.

TABLE 7

| Name of red-sensitive emulsion | Grain size (Side-length,μm) | Coefficient of variation of grain size | Iridium content (mol/Ag mol) |
|---|---|---|---|
| 2-R1 | 0.40 | 0.09 | $1.1\times10^{7}$ |
| 2-R2 | 0.40 | 0.08 | $2.2\times10^{7}$ |
| 2-R3 | 0.40 | 0.09 | $3.7\times10^{7}$ |
| 2-R4 | 0.40 | 0.09 | $4.4\times10^{7}$ |
| 2-R1' | 0.34 | 0.08 | $1.2\times10^{7}$ |
| 2-R2' | 0.34 | 0.08 | $2.3\times10^{7}$ |
| 2-R3' | 0.34 | 0.09 | $4.4\times10^{7}$ |
| 2-R4' | 0.34 | 0.08 | $5.0\times10^{7}$ |

Blue-sensitive emulsions 2-B1 and 2-B1', and Green-sensitive emulsions 2-G1 and 2-G1' were prepared in the same manner as the Red-sensitive emulsion 2-R1, except that the temperature of Solution I and the addition rates of the Solutions II to V were altered, and the amount of potassium hexacyano ferrate(II) in the Solution V was altered, the amounts of both chemicals to be added after the pAg adjustment and potassium hexachloroiridate (IV) in the silver chlorobromide fine grains were altered, and further the above-mentioned Blue-sensitive sensitizing dyes A, B and C, or the above-mentioned Green-sensitive sensitizing dyes D, E and F were added in place of the above-mentioned Red-sensitive sensitizing dye G, respectively.

Sensitizing Dye for Blue-Sensitive Emulsion Layer

The above-mentioned Sensitizing dyes A, B, and C were used.

(To a large-size emulsion 2-B1, was used the Blue-sensitive sensitizing dyes A, B, and C in amounts of $2.2\times10^{-4}$ mol, $3.0\times10^{-5}$ mol, and $1.8\times10^{-5}$ mol, per mol of the silver halide, respectively, and to a small-size emulsion 2-B1', was used the Blue-sensitive sensitizing dyes A, B, and C in amounts of $2.5\times10^{-4}$ mol, $3.4\times10^{-5}$ mol, and $2.1\times10^{-4}$ mol, per mol of the silver halide, respectively.)

Sensitizing Dye for Green-Sensitive Emulsion Layer

The above-mentioned Sensitizing dyes D, E, and F were used.

(To a large-size emulsion 2-G1, was used the Green-sensitive sensitizing dyes D, E, and F in amounts of $3.0\times10^{-4}$ mol, $6.0\times10^{-5}$ mol, and $1.0\times10^{-5}$ mol, per mol of the silver halide, respectively, and to a small-size emulsion 2-G1', was used the Green-sensitive sensitizing dyes D, E, and F in amounts of $3.7\times10^{-4}$ mol, $7.4\times10^{-5}$ mol, and $1.2\times10^{-5}$ mol, per mol of the silver halide, respectively.)

Preparation of Samples (2101) to (2107)

Sample (2101) was prepared in the same manner as Sample (1101), except that the silver chloro-bromide emulsions for the first, third, and fifth layers were respectively changed to those shown below, with the same coating amounts.

First Layer (Blue-Sensitive Emulsion Layer)

A silver chlorobromide emulsion (Cubes, a mixture of a large-size emulsion 2-B1 having an average grain size of 0.71 μm, and a small-size emulsion 2-B1' having an average grain size of 0.62 μm (3:7 in terms of mol of silver). The deviation coefficients of the grain size distributions were 0.08 and 0.10, respectively, and each emulsion had 0.28 mol % and 0.33 mol %, respectively, of a silver bromide locally contained in part of the grain surface whose substrate was made up of silver chloride.)

Third Layer (Green-Sensitive Emulsion Layer)

A silver chlorobromide emulsion (Cubes, a mixture of a large-size emulsion 2-G1 having an average grain size of 0.42 μm, and a small-size emulsion 2-G1' having an average grain size of 0.33 μm (3:7 in terms of mol of silver). The deviation coefficients of the grain size distributions were 0.10 and 0.08, respectively, and each emulsion had 0.69 mol % and 0.81 mol %, respectively, of a silver bromide locally contained in part of the grain surface whose substrate was made up of silver chloride.)

Fifth Layer (Red-Sensitive Emulsion Layer)

A silver chlorobromide emulsion (Cubes, a mixture of a large-size emulsion 2-R1having an average grain size of 0.40 μm, and a small-size emulsion 2-R1' having an average grain size of 0.34 μm (6:4 in terms of mol of silver). The deviation coefficients of the grain size distributions were 0.09 and 0.08, respectively.)

Samples (2102) to (2107) were prepared in the same manner as Sample (2101), except for changing the Red-sensitive emulsion of the fifth layer to emulsions, as described in Table 8.

TABLE 8

| Name of sample | Red-sensitive emulsion High-sensitivity emulsion/ Low-sensitivity emulsion |
|---|---|
| 2101 | 2-R1/2-R1' |
| 2102 | 2-R2/2-R2' |
| 2103 | 2-R3/2-R2' |
| 2104 | 2-R4/2-R2' |
| 2105 | 2-R2/2-R3' |
| 2106 | 2-R3/2-R3' |
| 2107 | 2-R3/2-R4' |

To the Sample (2101), the exposure to light and processing were carried out in the same manner for Sample (1101).

A colored density of the Sample (2101) processed as described above was measured, and sensitometry corresponding to the red-sensitive cyan coloring layer was conducted to obtain a characteristic curve. As to the thus-obtained characteristic curve, an exposure amount required to provide the density of [a density at the unexposed portion+0.02] was read. Thereafter, color densities (i.e., D1 and D2) obtained by each of exposure amounts 10 times and 30 times the thus-read exposure amount, were measured, respectively.

Further, Sample (2101) was subjected to a gradation exposure for sensitometry through a red filter using the above-mentioned sensitometer (Model HIE, manufactured by Fuji Photo Film Co., Ltd.) for an exposure time of $10^{-4}$ sec or $10^{-6}$ sec, respectively, and processed with the above processing. A color density of the processed Sample (2101) was measured, and sensitometry for $10^{-4}$ sec and $10^{-6}$ sec exposures corresponding to the red-sensitive cyan coloring layer was conducted to obtain respective characteristic curves. As to the characteristic curve thus-obtained by a $10^{-4}$ sec exposure, an exposure amount required to provide the density of [a density at the unexposed portion+0.02] was read. Thereafter, color densities (i.e., D1' and D2') obtained by each of exposure amounts 10 times and 30 times the thus-read exposure amount, were measured respectively. As to the characteristic curve thus-obtained by a $10^{-6}$ sec exposure, an exposure amount required to provide the density of [a density at the unexposed portion+0.02] was read. Thereafter, color densities (i.e., D1" and D2") obtained by each of exposure amounts 10 times and 30 times the thus-read exposure amount, were measured respectively.

A negative image was obtained by photographing using NEXIAH 400 (trade name, a negative film manufactured by Fuji Photo Film Co., Ltd.), followed by a processing of the film. Sample (2101) was subjected to a surface exposure through the negative obtained by means of SUPER FA-238 (trade name, a minilab manufactured by Fuji Photo Film Co., Ltd.), followed by a processing, to thereby obtain a color print image due to a surface exposure. Further, a gray image having the density of 1.0 was subjected to a scanning exposure while modulating so as to vary the quantity of light from each laser light source, by means of FRONTIER 350 (trade name, a digital minilab manufactured by Fuji Photo Film Co., Ltd.; output scale: $10^{-7}$ sec per pixel (image element), blue light 40 $\mu$W, green light 300 $\mu$W, red light 2 mW) or Lambda 130 (trade name, a digital exposure apparatus manufactured by DURST), followed by a processing, to thereby obtain a gray print image (one sixth size: 20.3 cm×25.4 cm) due to each kind of scanning exposure. Further, a scanning exposure was conducted in the maximum exposure amount using these digital exposure apparatuses, followed by a processing and a color densitometric measurement, so that the maximum colored density (Dmax) due to each kind of scanning exposure was obtained.

The photographic property difference between the image obtained by the scanning exposure which was a high illumination intensity short time exposure, and that due to an ordinary surface exposure was evaluated in terms of D1'/D1, D1"/D1, D2'/D2, D2"/D2', Dmax and the print images obtained by the above-mentioned techniques. The evaluation of the gray images obtained by a scanning exposure was conducted by the evaluation system of classifying them into the following four grades regarding the change in color balance at the central portion and the peripheral portion. The term "change in color balance" herein used refers to an increase in a cyan tint (an image with an increased cyan tint).

⊙—because no change in color balance was observed at the peripheral portion.

○—Within the maximum permissible limit even though a slight change in color balance was observed by the naked eye at the peripheral portion.

Δ—Not permissible because a substantial change in color balance was observed at the peripheral portion.

X—Not permissible because a large change in color balance was observed at the peripheral portion.

The same evaluation as Sample (2101) was also conducted with respect to Samples (2102) to (2107).

As a result, each of the color print images obtained by subjecting Samples (2101) to (2107) to a surface exposure was excellent. From the results shown in Table 9, it is understood that with respect to Samples (2101) to (2103), each maximum density obtained by each kind of scanning exposure apparatuses was quite low, and with respect to Sample (2104), a colored density obtained by one kind of scanning exposure apparatuses was still quite low, and in addition the change in color balance at the peripheral portion of the image obtained by scanning exposure was conspicuous, so that there was a problem regarding a color print. On the other hand, it is apparent that with respect to Samples (2105) to (2107) according to the present invention, the image obtained by each kind of scanning exposure had a high maximum density and in addition provided a small change in color balance at the peripheral portion, and therefore they were excellent in a color print material.

TABLE 9

| Name of sample | D1'/D1 | D1"/D1' | D2'/D2 | D2"/D2' | Dmax *1 | Dmax *2 | Change of color balance in peripheral portion *1 | Change of color balance in peripheral portion *2 | Remarks |
|---|---|---|---|---|---|---|---|---|---|
| 2101 | 0.60 | 0.75 | 0.80 | 0.58 | 2.20 | 2.09 | ⊙ | ⊙ | Comparative example |
| 2102 | 0.67 | 0.85 | 0.82 | 0.74 | 2.25 | 2.11 | ⊙ | ⊙ | Comparative example |
| 2103 | 0.83 | 0.92 | 0.83 | 0.77 | 2.27 | 2.19 | ○ | ○ | Comparative example |
| 2104 | 0.98 | 0.95 | 0.90 | 0.80 | 2.55 | 2.29 | Δ | x | Comparative example |
| 2105 | 0.65 | 0.90 | 0.92 | 0.91 | 2.50 | 2.45 | ⊙ | ⊙ | This invention |
| 2106 | 0.76 | 0.94 | 0.94 | 0.97 | 2.53 | 2.51 | ⊙ | ⊙ | This invention |

TABLE 9-continued

| Name of sample | D1'/D1 | D1"/D1' | D2'/D2 | D2"/D2' | Dmax *1 | Dmax *2 | Change of color balance in peripheral portion *1 | Change of color balance in peripheral portion *2 | Remarks |
|---|---|---|---|---|---|---|---|---|---|
| 2107 | 0.84 | 0.96 | 0.95 | 0.97 | 2.53 | 2.51 | ○ | ○ | This invention |

*1 Scanning-exposure was conducted using FRONTIER350.
*2 Scanning-exposure was conducted using Lambda130.

Example 2-2

Red-sensitive emulsion 2-R5 was prepared in the same manner as the foregoing Red-sensitive emulsion 2-R3, except that the amount of potassium hexacyano ferrate (II) in the Solution V was altered from $7.0\times10^{-6}$ mole to $1.4\times10^{-5}$ mole, per mole of silver halide, and the amount of potassium hexachloro iridate (IV) in the silver chlorobromide fine grains to be added during a preparation of the emulsion was altered from $3.7\times10^{-7}$ mole to $3.0\times10^{-7}$ mole, per mole of silver halide. Red-sensitive emulsion 2-R5' was prepared in the same manner as the foregoing Red-sensitive emulsion 2-R3', except that the amount of potassium hexacyano ferrate (II) in the Solution V was altered from $7.0\times10^{-6}$ mole to $1.7\times10^{-5}$ mole, per mole of silver halide, and the amount of potassium hexachloro iridate (IV) in the silver chlorobromide fine grains to be added during a preparation of the emulsion was altered from $4.4\times10^{-7}$ mole to $3.9\times10^{-7}$ mole, per mole of silver halide.

In order to evaluate production stability of the Red-sensitive emulsions 2-R3, 2-R3', 2-R5 and 2-R5', each of these emulsions was prepared three times. In Table 10, preparation numbers are indicated as #1 to #3.

Samples (2201) to (2206) were prepared in the same manner as Sample (2101), except that the Red-sensitive emulsion to be used therein was altered to the Red-sensitive emulsion 2-R3, 2-R3', 2-R5 and 2-R5' as indicated in Table 10 respectively.

The Samples (2201) to (2206) were also evaluated in the same manner as in Example 2-1.

Similarly to the results in Example 2-1, each color print image obtained by subjecting the Samples (2201) to (2206) according to the present invention to a surface exposure was excellent. In addition, the change in color balance at the peripheral portion and the maximum density of the color print image obtained by each kind of scanning exposure were also excellent respectively. It is apparent from the results shown in Table 10 that the Samples (2204) to (2206) in each of which two kinds of complexes of metal of the group VIII of the periodic table were contained in the red-sensitive emulsion in the amount so as to become different from each other by 20 times or more, provided a more stable performance in the repetition of the emulsion production, as compared to the Samples (2201) to (2203).

In this Example, when an image was obtained by subjecting the Samples (2201) to (2203) to a scanning exposure, gradation retouch by means of a calibration function was needed in every time for each of these samples in order to harmonize the color balance of the finished image. On the other hand, in the case where the Samples (2204) to (2206) were used, once the calibration was conducted with any one of these samples, a satisfactory image was obtained in every sample of the Samples (2204) to (2206). It is also apparent from the above-mentioned results that the Samples (2204) to (2206) were excellent and more preferable in the productivity.

TABLE 10

| Name of sample | Red-sensitive emulsion High-sensitivity emulsion/Low-sensitivity emulsion | D1'/D1 | D1"/D1' | D2'/D2 | D2"/D2' | Dmax *1 | Dmax *2 | Remarks |
|---|---|---|---|---|---|---|---|---|
| 2201 | 2-R3#1/2-R3'#1 | 0.75 | 0.94 | 0.98 | 0.98 | 2.50 | 2.53 | This invention |
| 2202 | 2-R3#2/2-R3'#2 | 0.67 | 0.90 | 0.92 | 0.94 | 2.49 | 2.50 | This invention |
| 2203 | 2-R3#3/2-R3'#3 | 0.71 | 0.90 | 0.92 | 0.90 | 2.55 | 2.49 | This invention |
| 2204 | 2-R5#1/2-R5'#1 | 0.74 | 0.93 | 0.96 | 0.96 | 2.56 | 2.52 | This invention |
| 2205 | 2-R5#2/2-R5'#2 | 0.74 | 0.95 | 0.94 | 0.95 | 2.53 | 2.54 | This invention |
| 2206 | 2-R5#3/2-R5'#3 | 0.76 | 0.94 | 0.94 | 0.95 | 2.55 | 2.54 | This invention |

*1 Scanning-exposure was conducted using FRONTIER350.
*2 Scanning-exposure was conducted using Lambda130.

Having described our invention as related to the present embodiments, it is our intention that the invention not be limited by any of the details of the description, unless otherwise specified, but rather be construed broadly within its spirit and scope as set out in the accompanying claims.

What I claim is:

1. A silver halide color photographic light-sensitive material, comprising at least one blue-sensitive silver halide emulsion layer containing a yellow coupler, at least one green-sensitive silver halide emulsion layer containing a magenta coupler, and at least one red-sensitive silver halide emulsion layer containing a cyan coupler, provided on a support, wherein at least one layer of said light-sensitive silver halide emulsion layers contains at least two emulsions each having a silver halide emulsion comprising sliver halide grains having a silver chloride content of 95 mol % or more and being different from each other in photographic speed and in the amount of a complex of a metal of group VIII of the periodic table, and wherein, with respect to each of characteristic curves obtained by a color development of said light-sensitive material after exposure, the following relationships are satisfied:

$$0.65 \leqq D1'/D1 \leqq 0.85$$

$$1.1 \leqq \log(E2/E1) \leqq 1.4$$

wherein D1 represents a density obtained by exposing to light in an exposure amount ten times as much as that required to provide a density of 0.02+the density of the unexposed portion, in the characteristic curve obtained by a $10^{-1}$-sec exposure, D1' represents a density obtained by exposing to light in an exposure amount ten times as much as that required to provide a density of 0.02+the density of the unexposed portion, in the characteristic curve obtained by a $10^{-4}$-sec exposure, E1 represents an exposure amount required to provide a density of 0.02+the density of the unexposed portion, in the characteristic curve obtained by a $10^{-4}$-sec exposure, and E2 represents, in the characteristic curve obtained by a $10^{-4}$-sec exposure, an exposure amount required to provide a density 0.92 times the maximum density in the characteristic curve obtained by a $10^{-1}$ -sec exposure.

2. The silver halide color photographic light-sensitive material as claimed in claim 1, wherein the relationships defined in claim 1 are defined with characteristic curves obtained by a color development of said light-sensitive material after exposure to red light.

3. The silver halide color photographic light-sensitive material as claimed in claim 1, wherein said emulsion comprises silver halide grains having a silver chloride content of 95 mole % or more and doped with at least two metal complexes, where each metal of said metal complexes is independently selected from the elements of group VIII in the periodic table.

4. The silver halide color photographic light-sensitive material as claimed in claim 3, wherein said metal complexes are concentrated on the surface layer which is 50% or less of the volume of an individual silver halide grain so as to become richer than the other portion of the silver halide grain.

5. The silver halide color photographic light-sensitive material as claimed in claim 3, wherein said metal complexes are a complex of iron and a complex of iridium, or a complex of ruthenium and a complex of iridium.

6. A silver halide color photographic light-sensitive material, comprising at least one blue-sensitive silver halide emulsion layer containing a yellow coupler, at least one green-sensitive silver halide emulsion layer containing a magenta coupler, and at least one red-sensitive silver halide emulsion layer containing a cyan coupler, provided on a support, wherein at least one layer of said light-sensitive silver halide emulsion layers contains at least two emulsions each having a silver halide emulsion comprising silver halide grains having a silver chloride content of 95 mol % or more and being different from each other in photographic speed and in the amount of a complex of a metal of group VIII of the periodic table, and wherein, with respect to each of characteristic curves obtained by a color development of said light-sensitive material after exposure, the following relationships are satisfied:

$$0.65 \leqq D1'/D1 \leqq 0.85$$

$$0.90 \leqq D1''/D1' \leqq 1.00$$

$$0.90 \leqq D2'/D2 \leqq 1.00$$

$$0.90 \leqq D2''/D2' \leqq 1.00$$

wherein D1 represents a density obtained by exposing to light in an exposure amount ten times as much as that required to provide a density of 0.02+the density of the unexposed portion, in the characteristic curve obtained by a $10^{-1}$-sec exposure, D1' represents a density obtained by exposing to light in an exposure amount ten times as much as that required to provide a density of 0.02+the density of the unexposed portion, in the characteristic curve obtained by a $10^{-4}$-sec exposure, D1" represents a density obtained by exposing to light in an exposure amount ten times as much as that required to provide a density of 0.02+the density of the unexposed portion, in the characteristic curve obtained by a $10^{-6}$-sec exposure, D2 represents a density obtained by exposing to light in an exposure amount thirty times as much as that required to provide a density of 0.02+the density of the unexposed portion, in the characteristic curve obtained by a $10^{-1}$-sec exposure, D2' represents a density obtained by exposing to light in an exposure amount thirty times as much as that required to provide a density of 0.02+the density of the unexposed portion, in the characteristic curve obtained by a $10^{-4}$-sec exposure, and D2" represents a density obtained by exposing to light in an exposure amount thirty times as much as that required to provide a density of 0.02+the density of the unexposed portion, in the characteristic curve obtained by a $10^{-6}$-sec exposure.

7. The silver halide color photographic light-sensitive material as claimed in claim 6, wherein the relationships defined in claim 6 are defined with characteristic curves obtained by a color development of said light-sensitive material after exposure to a red light.

8. The silver halide color photographic light-sensitive material as claimed in claim 6, wherein at least one layer of said light-sensitive silver halide emulsion layers contains silver halide grains having a silver chloride content of 95 mol % or more, and doped with at least two metal complexes, where each metal of said metal complexes is independently selected from the elements of group VIII in the periodic table and the doping is conducted with molar amounts of the metal complexes different from each other by twenty times or more.

9. The silver halide color photographic light-sensitive material as claimed in claim 8, wherein said metal complexes are concentrated on the surface layer which is 50% or less of the volume of an individual silver halide grain so as to become richer than the other portion of the silver halide grain.

10. The silver halide color photographic light-sensitive material as claimed in claim 8, wherein said metal complexes are a complex of iron and a complex of iridium, or a complex of ruthenium and a complex of iridium.

11. A silver halide color photographic light-sensitive material, comprising at least one blue-sensitive silver halide emulsion layer containing a yellow coupler, at least one green-sensitive silver halide emulsion layer containing a magenta coupler, and at least one red-sensitive silver halide emulsion layer containing a cyan coupler, provided on a support, wherein at least one layer of said light-sensitive silver halide emulsion layers contains at least two emulsions each having a silver halide emulsion comprising silver halide grains having a silver chloride content of 95 mol % or more and being different from each other in photographic speed and in the amount of a complex of a metal of group VIII of the periodic table, and wherein, with respect to each of characteristic curves obtained by a color development of said light-sensitive material after exposure, the following relationships are satisfied:

$$0.6. \leqq D1'/D1 \leqq 0.85$$

$$1.1 \leqq \log(E2/E1) \leqq 1.4$$

$$0.90 \leqq D1''/D1' \leqq 1.00$$

$$0.90 \leqq D2'/D2 \leqq 1.00$$

$$0.90 \leqq D2''/D2' \leqq 1.00$$

wherein D1 represents a density obtained by exposing to light in an exposure amount ten times as much as that required to provide a density of 0.02+the density of the unexposed portion, in the characteristic curve obtained by a $10^{-1}$-sec exposure, D1' represents a density obtained by exposing to light in an exposure amount ten times as much as that required to provide a density of 0.02+the density of the unexposed portion, in the characteristic curve obtained by a $10^{-4}$-sec exposure, E1 represents an exposure amount required to provide a density of 0.02+the density of the unexposed portion, in the characteristic curve obtained by a $10^{-4}$-sec exposure, and E2 represents, in the characteristic curve obtained by a $10^{-4}$-sec exposure, an exposure amount required to provide a density 0.92 times the maximum density in the characteristic curve obtained by a $10^{-1}$-sec exposure, D1" represents a density obtained by exposing to light in an exposure amount ten times as much as that required to provide a density of 0.02+the density of the unexposed portion, in the characteristic curve obtained by a $10^{-6}$-sec exposure, D2 represents a density obtained by exposing to light in an exposure amount thirty times as much as that required to provide a density of 0.02+the density of the unexposed portion, in the characteristic curve obtained by a $10^{-1}$-sec exposure, D2' represents a density obtained by exposing to light in an exposure amount thirty times as much as that required to provide a density of 0.02+the density of the unexposed portion, in the characteristic curve obtained by a $10^{-4}$-sec exposure, and D2" represents a density obtained by exposing to light in an exposure amount thirty times as much as that required to provide a density of 0.02+the density of the unexposed portion, in the characteristic curve obtained by a $10^{-6}$-sec exposure.

* * * * *